US012116881B2

(12) United States Patent
Johnston et al.

(10) Patent No.: US 12,116,881 B2
(45) Date of Patent: Oct. 15, 2024

(54) DOWNHOLE TOOL WITH PASSIVE BARRIER

(71) Applicant: SPARTAN DOWNHOLE, LLC, Houston, TX (US)

(72) Inventors: Jeffrey Johnston, Houston, TX (US); Justin Scruggs, Houston, TX (US); William Amend, Yorba Linda, CA (US); Daniel Hoyer, Rapid City, SD (US); William Kovacs, III, Dublin, OH (US); Fei Tang, Katy, TX (US); Chris Taylor, Westerville, OH (US)

(73) Assignee: SPARTAN TECHNOLOGY DEVELOPMENT CORP., Houston, TX (US)

( * ) Notice: Subject to any disclaimer, the term of this patent is extended or adjusted under 35 U.S.C. 154(b) by 90 days.

(21) Appl. No.: 17/942,129

(22) Filed: Sep. 10, 2022

(65) Prior Publication Data

US 2023/0083743 A1 Mar. 16, 2023

Related U.S. Application Data

(60) Provisional application No. 63/243,468, filed on Sep. 13, 2021.

(51) Int. Cl.
*E21B 47/017* (2012.01)

(52) U.S. Cl.
CPC ..... *E21B 47/017* (2020.05)

(58) Field of Classification Search
CPC ..... E21B 47/017
See application file for complete search history.

(56) References Cited

U.S. PATENT DOCUMENTS

| | | | | |
|---|---|---|---|---|
| 4,036,285 | A * | 7/1977 | Best | E21B 36/003 165/45 |
| 6,684,637 | B2 * | 2/2004 | Beale | F28F 13/06 165/10 |
| 6,778,389 | B1 * | 8/2004 | Glovatsky | H05K 1/189 361/720 |
| 8,950,489 | B2 * | 2/2015 | Ayers | E21B 47/017 166/57 |
| 10,034,412 | B2 * | 7/2018 | Reid | H05K 7/20545 |
| 11,424,505 | B2 * | 8/2022 | Pare | H01M 50/56 |

(Continued)

*Primary Examiner* — Robert E Fuller
(74) *Attorney, Agent, or Firm* — CLEARPAT SERVICES, LLC

(57) ABSTRACT

An apparatus including an assembly associated with a downhole tool configured to thermally isolate a thermally sensitive component. Components of the assembly include an external isolating vessel; a passive thermal barrier encased in the external isolating vessel; at least one electronic component housed within the downhole tool for monitoring geothermal well properties; and at least one thermally sensitive electronics carrier package positioned within the passive thermal barrier comprising thermally sensitive electronic components. The passive thermal barrier ideally comprises an additively manufactured layered labyrinthine shell structure, a plurality of polarly phased centralizers between shell layers and minimal centralizing contact points on its exterior shell, to minimize known heat transfer modes associated with the external isolating vessel.

24 Claims, 10 Drawing Sheets

(56) References Cited

U.S. PATENT DOCUMENTS

| | | | | |
|---|---|---|---|---|
| 11,665,858 | B2 * | 5/2023 | Gooden | H05K 7/2049<br>165/185 |
| 2019/0316442 | A1 * | 10/2019 | Rafie | E21B 36/001 |
| 2019/0316460 | A1 * | 10/2019 | Mannas | E21B 47/017 |
| 2020/0408081 | A1 * | 12/2020 | Finke | H05K 1/144 |

* cited by examiner

SECTION 2-2

SECTION 3-3

| emissivity | time to heat up to 200 °C, h |
|---|---|
| 0.15 | 21.5 |
| 0.25 | 19.0 |
| 0.35 | 17.4 |
| 0.45 | 16.3 |

Impact of emissivity of inner surface of stainless-steel sink

DOWNHOLE TOOL WITH PASSIVE BARRIER

CROSS-REFERENCE

This application claims the benefit of U.S. Provisional Application No. 63/243,468, filed Sep. 13, 2021, which application is incorporated herein by reference.

BACKGROUND OF THE INVENTION

Without limiting the scope of the present invention, its background will be described in relation to improvement on current metallurgical and electro/mechanical technologies associated with drilling, completion, and production of subterranean wells to accommodate a full range of geothermal temperatures, including the extreme temperatures that are typically encountered in association with geothermal energy production.

This invention relates, in general, to a wellbore tool utilized for monitoring various wellbore parameters, including pressure and temperature which is essential for various tests including the "fall off" test that is used to evaluate reservoir permeability.

The invention is related to a wellbore tool and components thereof for monitoring various wellbore parameters for greater than 6 hours, at temperatures often in excess of 300° C., utilizing additive manufacturing technologies, when practical and cost effective, and/or other conventional manufacturing techniques, through employment of computational design strategies, to design new tools that are capable of protecting thermally sensitive components within said tools in high temperature geothermal well environments.

SUMMARY OF THE INVENTION

The present disclosure details a system for a different, more reliable, more precise, and cost-effective downhole tool. The disclosed apparatus uses a combination of phase-change materials, geometries and additive manufacturing techniques, when practical and cost effective, and/or other conventional manufacturing techniques, to develop a proprietary tool comprising a unique heat sink concept, also referred to as a passive thermal barrier, capable of protecting sensitive electronic measurement instrumentation encased therein for longer periods of time than currently available geothermal downhole tools.

Provided herein is a passive thermal barrier for use in a downhole tool comprising: a multi-layered labyrinthine shell structure having a plurality of at least two layers, comprising an external shell layer and at least one internal shell layer, a plurality of centralizers, polarly phased and longitudinally spaced, between each layer of the multi-layered labyrinthine shell structure, radially equidistant to a central axis and a plurality of point contacts polarly phased and longitudinally spaced on the external layer of the labyrinthine shell structure, radially equidistant to the central axis.

In some embodiments, the passive thermal barrier is manufactured using additive manufacturing techniques.

In some embodiments, the passive thermal barrier is manufactured using conventional casting, forging, machining and/or manufacturing techniques.

In some embodiments, the passive thermal barrier is manufactured using a combination of conventional casting, forging, machining and/or additive manufacturing techniques.

In any embodiment of the passive thermal barrier, the passive thermal barrier is further manufactured using any variety of grinding and polishing techniques to reduce emissivity on the internal surfaces, external surfaces or both internal and external surfaces of the at least two layers of the multi-layered labyrinthine shell structure.

In some embodiments of the passive thermal barrier, the multi-layered labyrinthine shell structure is generally cylindrical.

In some embodiments of the passive thermal barrier, the multi-layered labyrinthine shell structure may be rounded, columnar, tubular, conic, ovoid, annular, capsular, elliptical, ovular, cylindroid, rodlike, barrel-shaped, or any combination thereof.

In some embodiments of the passive thermal barrier, at least one internal shell layer of the multi-layered labyrinthine shell structure may be rounded, columnar, tubular, conic, ovoid, annular, elliptical, ovular, cylindroid, rodlike, barrel-shaped, or any combination thereof.

In some embodiments of the passive thermal barrier, each layer of the two or more layers of the multi-layered labyrinthine shell structure need not be the same shape as an adjacent layer.

In some embodiments of the passive thermal barrier, the plurality of centralizers are polarly phased at different radial coordinates between each layer of the labyrinthine shell structure.

In some embodiments, the plurality of centralizers comprises: at least one set of at least two centralizers between each layer, each centralizer polarly positioned apart from each other and radially equidistant to the central axis, to achieve centralization between each layer of the labyrinthine shell structure, and wherein each centralizer within each set of at least two centralizers are longitudinally spaced apart and separated from each other centralizer in the set such that each layer of the passive thermal barrier would be centrally positioned and radially equidistant to the central axis of the passive thermal barrier.

In some embodiments of the passive thermal barrier, the plurality of centralizers are further longitudinally spaced at different longitudinal locations between each layer of the labyrinthine shell structure, from the layer above and or the layer below.

In some embodiments of the passive thermal barrier, the plurality of centralizers comprise a minimum of one set of at least three centralizers between each layer, wherein each centralizer of each set is ideally spaced at 120 degrees from the nearest adjacent centralizer within the set, and wherein each centralizer within each set of at least three centralizers are longitudinally spaced apart and separated from each other centralizer in the set such that each layer of the passive thermal barrier would be centrally positioned and radially equidistant to the central axis of the passive thermal barrier.

In some embodiments of the passive thermal barrier, the plurality of centralizers comprises a minimum of one set of at least three centralizers between each layer, wherein each centralizer of each set is spaced between 100 degrees and 140 degrees from the nearest adjacent centralizer within the set.

In some embodiments of the passive thermal barrier, the plurality of centralizers comprises two or more sets of at least three centralizers.

In any embodiment of the passive thermal barrier, the plurality of centralizers ideally comprises a material or materials having a low thermal conductivity.

In some embodiments of the passive thermal barrier, the plurality of centralizers comprises ceramic materials, glass materials, metal materials, phase-change materials or a composite thereof, to limit or reduce thermal conductivity between each layer of the labyrinthine shell structure.

In some embodiments of the passive thermal barrier, the passive thermal barrier further comprising a plurality of contact points polarly phased and longitudinally spaced on the external layer of the labyrinthine shell structure, radially equidistant to the central axis, wherein the plurality of external contacts point comprise: at least one set of at least two contact points between each layer, each contact point polarly positioned apart from each other and radially equidistant to the central axis, to achieve centralization between each layer of the labyrinthine shell structure, and wherein each contact point within each set of at least two contact points are longitudinally spaced apart and separated from each other contact point such that the passive thermal barrier would be centrally positioned and radially balanced within a downhole tool and parallel to the central axis.

In some embodiments of the passive thermal barrier, the plurality of external point contacts comprise a minimum of one set of at least three contact points, wherein each contact point is ideally spaced at 120 degrees from the nearest adjacent contact point within the set, and wherein each contact point within each set of at least three contact points are longitudinally spaced apart and separated from each other contact point such that the passive thermal barrier would be centrally positioned and radially balanced within a downhole tool, and approximately parallel to the central axis.

In some embodiments of the passive thermal barrier, the plurality of external point contacts comprises a minimum of one set of at least three-point contacts between each layer, wherein each point contact of each set is spaced between 100 degrees and 140 degrees from the nearest adjacent point contact within the set.

In some embodiments of the passive thermal barrier, the plurality of external point contacts comprises two or more sets of at least three contact points.

In any embodiment of the passive thermal barrier, the plurality of external point contacts ideally comprises a material or materials having a relatively low thermal conductivity.

In some embodiments of the passive thermal barrier, the plurality of external point contacts comprises ceramic materials, glass materials, metal materials, phase-change materials, or a composite thereof, to limit or reduce thermal conductivity between each layer of the labyrinthine shell structure.

In some embodiments of the passive thermal barrier, the manufactured, multi-layered labyrinthine shell structure comprises at least two pieces comprising an upper passive thermal barrier piece and a lower passive thermal barrier piece.

In some embodiments of the passive thermal barrier, the at least two pieces of the passive thermal barrier are subsequently machined and polished, to add assembly features and reduce emissivity.

In some embodiments, various grinding techniques such as cylindrical, centerless, or surface grinding, for example, may also be employed along with various polishing techniques such as wet sanding, die grinding, buffing and polishing wheels, and polishing compound to achieve a desired low-emissivity surface finish. Other polishing techniques may include closely controlled conditions such as electropolishing, lapping and superfinishing.

In some embodiments, the passive thermal barrier further comprises an external pressure-isolating vessel, wherein the external pressure-isolating vessel comprises at least a top sub, and a bottom sub.

In some embodiments, the external pressure-isolating vessel further comprises at least one housing vessel between the top sub and the bottom sub.

In some embodiments of the passive thermal barrier, the assembly features comprise threads; tapers; screws; compression fittings; interlocking features; or a combination thereof.

In some embodiments of the passive thermal barrier, the multi-layered labyrinthine shell structure of the passive thermal barrier comprises a third, fourth or more pieces, between the at least two pieces comprising the upper passive thermal barrier piece and the lower passive thermal barrier piece.

In some embodiments of the passive thermal barrier, the layered labyrinthine shell structure comprises at least 2 layers; at least 3 layers; at least 4 layers; at least 5 layers; or at least 6 layers. In some embodiments of the passive thermal barrier, the layered labyrinthine shell structure comprises "x" layers; (i.e.: more than 6 layers).

In some embodiments of the passive thermal barrier, the number of layers and a mass of each layer are determined according to a calculation for a desired reduction of conductive thermal energy and radiative thermal energy transfer over a desired period.

In some embodiments of the passive thermal barrier, the at least two pieces of the passive thermal barrier each comprise: some part of an inner layer of the multi-layered labyrinthine shell structure; some part of an outer layer of the multi-layered labyrinthine shell structure; some part of each layer of the multi-layered labyrinthine shell structure; at least 5% of each layer of the multi-layered labyrinthine shell structure; at least 15% of each layer of the multi-layered labyrinthine shell structure; at least 25% of each layer of the multi-layered labyrinthine shell structure; at least 35% of each layer of the multi-layered labyrinthine shell structure; at least 45% of each layer of the multi-layered labyrinthine shell structure; or at least one layer of the multi-layered labyrinthine shell structure.

In some embodiments of the passive thermal barrier, the at least two pieces of the passive thermal barrier, each comprise: approximately 50% of the multi-layered labyrinthine shell structure.

In some embodiments of the passive thermal barrier, the structure of the labyrinthine design of each layer of the shell structure is configured to provide a tortuous conduction heat transfer path that reduces heat ingress from one layer to the next, and ultimately, to the hollow core.

In some embodiments, the passive thermal barrier further comprises a hollow core at or near the approximate center of the passive thermal barrier; a thermally sensitive electronics carrier package positioned within the hollow core, and at least one thermally sensitive electronic component positioned within the thermally sensitive electronics carrier.

In some embodiments of the passive thermal barrier, the at least one thermally sensitive electronic component positioned in the thermally sensitive electronics carrier package. comprises: a plurality of batteries; a data acquisition module to log data acquired from measurement components; a power processing module; a microcontroller; an analog to digital converter, a microprocessor, an accelerometer, a sensor input and filtering module, an input voltage connection and protection module and at least one memory module.

In some embodiments, the thermally sensitive electronics carrier package, or simply the "carrier package" is configured from Stainless Steel 316 but could use a different material if desired, preferably polished to reduce the emissivity as much as possible.

In some embodiments, the carrier package is further manufactured using any variety of polishing techniques to reduce emissivity on the internal surface, on the external surface or both the internal and external surfaces.

In some embodiments, the carrier package manufacturing process utilizes materials specifically configured for additive manufacturing (AM).

In some embodiments of the carrier package, the additive manufacturing process utilizes a variety of corrosion resistant, high temperature tolerant materials to gain a further thermal advantage.

In some embodiments of the passive thermal barrier, the manufacturing process utilizes materials specifically configured for additive manufacturing (AM).

In some embodiments of the passive thermal barrier, the manufacturing process utilizes cast materials.

In some embodiments of the passive thermal barrier, the manufacturing process utilizes forged materials.

In some embodiments of the passive thermal barrier, the manufacturing process utilizes polymers.

In some embodiments of the passive thermal barrier, the manufacturing process utilizes ceramic materials.

In some embodiments of the passive thermal barrier, the manufacturing process utilizes phase-change materials.

In some embodiments of the passive thermal barrier, the manufacturing process utilizes a corrosion resistant alloy or corrosion resistant steel alloy.

In some embodiments of the passive thermal barrier, the manufacturing process utilizes a variety of corrosion resistant, high temperature tolerant materials, on one or more shell layers, to gain a further thermal advantage.

In some embodiments of the passive thermal barrier, the additive manufacturing (AM) process utilizes a powder bed laser fusion (PBLF) manufacturing process comprising: Direct Metal Laser Sintering (DMLS); or Electron Beam Melting (EBM).

In some embodiments of the passive thermal barrier, the additive manufacturing (AM) process utilizes Lithography-based ceramic manufacturing (LCM).

In some embodiments of the passive thermal barrier, the additive manufacturing (AM) process utilizes other AM processes configured for ceramic materials.

In some embodiments of the passive thermal barrier, the additive manufacturing (AM) process utilizes other AM processes configured for phase-change materials.

In some embodiments of the passive thermal barrier, the additive manufacturing (AM) process utilizes other AM processes configured for polymers.

In some embodiments of the passive thermal barrier, the additive manufacturing process utilizes a corrosion resistant alloy or steel.

In some embodiments of the passive thermal barrier, the additive manufacturing process utilizes a variety of corrosion resistant, high temperature tolerant materials, on one or more shell layers to gain a further thermal advantage.

In some embodiments the plurality of centralizers comprises a shape having an end diameter of about 0.125" (⅛") or about 3.175 mm.

In some embodiments of the apparatus' passive thermal barrier, the plurality of centralizers between each layer of the labyrinthine shell structure are generally less than 0.125 inches and more preferably less than approximately 0.115 inches in diameter or the equivalent thereof.

In some embodiments of the passive thermal barrier, the surface area of each of the plurality of centralizers to less than about 0.0001 sq. ins to about 0.125 sq. ins. In some embodiments of the passive thermal barrier, the surface area of each of the plurality of centralizers to less than about at least about 0.0001 sq. ins. In some embodiments of the passive thermal barrier, the surface area of each of the plurality of centralizers to less than about at most about 0.125 sq. ins. In some embodiments of the passive thermal barrier, the surface area of each of the plurality of centralizers to less than about 0.0001 sq. ins to about 0.0005 sq. ins, about 0.0001 sq. ins to about 0.001 sq. ins, about 0.0001 sq. ins to about 0.00123 sq. ins, about 0.0001 sq. ins to about 0.002 sq. ins, about 0.0001 sq. ins to about 0.005 sq. ins, about 0.0001 sq. ins to about 0.01 sq. ins, about 0.0001 sq. ins to about 0.05 sq. ins, about 0.0001 sq. ins to about 0.1 sq. ins, about 0.0001 sq. ins to about 0.125 sq. ins, about 0.0005 sq. ins to about 0.001 sq. ins, about 0.0005 sq. ins to about 0.00123 sq. ins, about 0.0005 sq. ins to about 0.002 sq. ins, about 0.0005 sq. ins to about 0.005 sq. ins, about 0.0005 sq. ins to about 0.01 sq. ins, about 0.0005 sq. ins to about 0.05 sq. ins, about 0.0005 sq. ins to about 0.1 sq. ins, about 0.0005 sq. ins to about 0.125 sq. ins, about 0.001 sq. ins to about 0.00123 sq. ins, about 0.001 sq. ins to about 0.002 sq. ins, about 0.001 sq. ins to about 0.005 sq. ins, about 0.001 sq. ins to about 0.01 sq. ins, about 0.001 sq. ins to about 0.05 sq. ins, about 0.001 sq. ins to about 0.1 sq. ins, about 0.001 sq. ins to about 0.125 sq. ins, about 0.00123 sq. ins to about 0.002 sq. ins, about 0.00123 sq. ins to about 0.005 sq. ins, about 0.00123 sq. ins to about 0.01 sq. ins, about 0.00123 sq. ins to about 0.05 sq. ins, about 0.00123 sq. ins to about 0.1 sq. ins, about 0.00123 sq. ins to about 0.125 sq. ins, about 0.002 sq. ins to about 0.005 sq. ins, about 0.002 sq. ins to about 0.01 sq. ins, about 0.002 sq. ins to about 0.05 sq. ins, about 0.002 sq. ins to about 0.1 sq. ins, about 0.002 sq. ins to about 0.125 sq. ins, about 0.005 sq. ins to about 0.01 sq. ins, about 0.005 sq. ins to about 0.05 sq. ins, about 0.005 sq. ins to about 0.1 sq. ins, about 0.005 sq. ins to about 0.125 sq. ins, about 0.01 sq. ins to about 0.05 sq. ins, about 0.01 sq. ins to about 0.1 sq. ins, about 0.01 sq. ins to about 0.125 sq. ins, about 0.05 sq. ins to about 0.1 sq. ins, about 0.05 sq. ins to about 0.125 sq. ins, or about 0.1 sq. ins to about 0.125 sq. ins. In some embodiments of the passive thermal barrier, the surface area of each of the plurality of centralizers to less than about 0.0001 sq. ins, about 0.0005 sq. ins, about 0.001 sq. ins, about 0.00123 sq. ins, about 0.002 sq. ins, about 0.005 sq. ins, about 0.01 sq. ins, about 0.05 sq. ins, about 0.1 sq. ins, or about 0.125 sq. ins.

In one preferred embodiment of the passive thermal barrier, the tortuous conduction heat transfer path is configured to improve thermal performance between layers of the shell to reduce heat ingress by maintaining the surface area of each of the plurality of centralizers to less than or equal to about 0.0123 square inches.

In some embodiments of the passive thermal barrier, the tortuous conduction heat transfer path is configured to maximize thermal performance between layers of the shell to reduce heat ingress at the hollow core in geothermal environments.

In some embodiments of the passive thermal barrier, the outermost surface of the layered labyrinthine shell structure is configured to have a surface finish to create a thermal emissivity of about 0.05 or less. In some embodiments, the correlating surface roughness of the labyrinthine shell material is between about 8-32 μm.

In some embodiments of the passive thermal barrier, the inner surfaces of the layered labyrinthine shell structure are configured to have a surface finish to create a thermal emissivity of about 0.25 or less. In some embodiments, the correlating internal surface roughness of the labyrinthine shell material is between about 8-125 μm.

In some embodiments of the passive thermal barrier, said barrier is configured for use within a downhole logging tool.

In some embodiments, the downhole tool comprises: an external pressure-isolating vessel, wherein the external pressure-isolating vessel comprises at least a top sub, and a bottom sub and a plurality of measurement and electronic components housed within the tool.

In some embodiments, the external pressure-isolating vessel further comprises at least one housing between the top sub and the bottom sub.

In some embodiments, the external pressure-isolating vessel further comprises, the top sub and the bottom sub further comprise a plurality of point contact standoffs configured to engage with point contacts on the exterior surface of the on the external layer of the labyrinthine shell structure of the passive thermal barrier to provide a mechanism for longitudinally locating the passive thermal barrier centrally within the external pressure-isolating vessel.

In some embodiments, the external pressure-isolating vessel comprises a nickel-chrome based super alloy.

In some embodiments, the external pressure-isolating vessel of said downhole tool further comprises a vacuum port for drawing a vacuum on the passive thermal barrier, after assembly, to remove air in order to minimize convection heat transfer within the tool.

In some embodiments, the vacuum port for drawing a vacuum can be placed in the top sub; the bottom sub or the at least one housing between the top and bottom sub.

In some embodiments, the downhole tool further comprises material and design properties configured to withstand a well fluid environment comprising at least about 2% H2S; the presence of HCL; a concentration of at least about 20% NaCl Brine; and a pH≥2.

In some embodiments of the passive thermal barrier, said barrier is configured for use within a geothermal energy downhole logging tool.

In some embodiments of the passive thermal barrier, said barrier is configured for use within a downhole logging tool and configured to reduce heat ingress for a minimum of about 4.5 hours before exceeding a maximum of about 200° C. at the hollow core in geothermal environments comprising temperatures in excess of 300° C., but less than 450° C.

In some embodiments of the passive thermal barrier, the tortuous conduction heat transfer path is configured to reduce heat ingress to maximize thermal performance between layers of the labyrinthine shell to provide at least about 10.0 hours before exceeding a maximum of about 200° C. at the hollow core, in geothermal environments operating at temperatures in excess of 300° C., but less than 400° C.

Optionally, in any embodiment, the barrier is configured for use within a downhole logging tool and configured to reduce heat ingress for a minimum of about 4.5 hours before exceeding a maximum of about 200° C. in the thermally sensitive electronics carrier package positioned within the hollow core, in geothermal environments comprising temperatures in excess of 300° C., but less than 450° C.

Optionally, in any embodiment of the passive thermal barrier, the tortuous conduction heat transfer path is configured to reduce heat ingress to maximize thermal performance between layers of the labyrinthine shell to provide at least about 10.0 hours before exceeding a maximum of about 200° C. in the thermally sensitive electronics carrier package positioned within the hollow core, in geothermal environments operating at temperatures in excess of 300° C., but less than 400° C.

Optionally, in any embodiment of the passive thermal barrier, the tortuous conduction heat transfer path is configured to reduce heat ingress to maximize thermal performance between layers of the labyrinthine shell to provide at least about 100.0 hours before exceeding a maximum of about 200° C. in the thermally sensitive electronics carrier package positioned within the hollow core, in geothermal environments operating at temperatures in excess of 300° C., but less than 400° C.

Provided here is a downhole tool comprising a manufactured multi-layered passive thermal barrier with a hollow core, encased in an external pressure-isolating vessel; the external pressure-isolating vessel having at least two components comprising a top sub and a bottom sub; and a plurality of measurement and electronic components housed within the downhole tool.

In some embodiments, the downhole tool is manufactured using additive manufacturing techniques.

In some embodiments, the downhole tool is manufactured using conventional casting, forging, machining and/or grinding and polishing manufacturing techniques.

In some embodiments, the downhole tool is manufactured using a combination of conventional casting, forging, machining, grinding, polishing and/or additive manufacturing techniques.

In some embodiments, the external pressure-isolating vessel of the downhole tool further comprises at least one adjoining intermediate housing component.

In some embodiments, the external pressure-isolating vessel comprises a steel alloy.

In some embodiments, the external pressure isolating vessel comprises a ceramic coating.

In some embodiments, the external pressure isolating vessel comprises polished internal surfaces, external surfaces or both internal and external polished surfaces.

In some embodiments of the downhole tool, the plurality of measurement components housed within the downhole tool comprise a thermocouple, a temperature sensor and a pressure transducer.

In still further embodiments of the downhole tool, the plurality of measurement equipment may further comprise any one or more of a: flow meter, an accelerometer, an acoustic sensor, nuclear particle detector, a magnetometer, or any combination thereof.

In some embodiments, the external pressure-isolating vessel of downhole tool further comprises a vacuum port for drawing a vacuum on the passive thermal barrier after assembly within the tool, to remove air and reduce convection heat transfer within the tool.

In some embodiments of the downhole tool, the vacuum port is positioned in the top sub; in the bottom sub; or an adjoining intermediate housing.

In some embodiments, the downhole tool further comprises at least a first external port and optionally at least a second external port in the top sub, the bottom sub or an adjoining intermediate housing of the external pressure-isolating vessel configured for supporting measurement instruments to read geothermal data from a downhole environment.

In some embodiments of the downhole tool, the manufacturing process utilizes materials specifically configured for additive manufacturing (AM).

In some embodiments of the downhole tool, the manufacturing process utilizes cast materials.

In some embodiments of the downhole tool, the manufacturing process utilizes forged materials.

In some embodiments of the downhole tool, the manufacturing process utilizes polymers.

In some embodiments of the downhole tool, the manufacturing process utilizes ceramic materials.

In some embodiments of the downhole tool, the manufacturing process utilizes phase-change materials.

In some embodiments of the downhole tool, the manufacturing process utilizes a variety of corrosion resistant, high temperature tolerant materials, on one or more shell layers, to gain a further thermal advantage.

In some embodiments of the downhole tool, the passive thermal barrier is manufactured from a corrosion resistant alloy or from a corrosion resistant steel.

In some embodiments of the downhole tool, the passive thermal barrier is additively manufactured (AM) using powder bed metal fusion manufacturing methods comprising Direct Metal Laser Sintering (DMLS); or Electron Beam Melting (EBM).

In some embodiments of the downhole tool, the passive thermal barrier is additively manufactured (AM) using Directed Energy Deposition (DED) processes which generally do not use polymeric materials but employ metal wire or powder. High energy heating sources such as a laser are directed at the material to melt it and build-up the product.

In some embodiments of the downhole tool, the additive manufacturing (AM) process utilizes Lithography-based ceramic manufacturing (LCM).

In some embodiments of the downhole tool, the additive manufacturing (AM) process utilizes other AM processes configured for ceramic materials.

In some embodiments of the downhole tool, the additive manufacturing (AM) process utilizes other AM processes configured for phase-change materials.

In some embodiments of the downhole tool, the passive thermal barrier is additively manufactured using other AM process configured for polymers.

In some embodiments of the downhole tool, the passive thermal barrier is additively manufactured with polymers utilizing AM processes comprising photopolymerization, material jetting, powder bed fusion, and material extrusion. The materials used in these processes can be in the form of liquid, powder, or solid (formed materials such as polymer film or filament).

In some embodiments of the downhole tool, the passive thermal barrier is additively manufactured with a labyrinthine design structure that provides a non-direct heat transfer path to improve conductive thermal performance and reduce heat ingress from the external housing to the hollow core.

In some embodiments of the downhole tool, the manufacturing process utilizes polymers.

In some embodiments of the downhole tool, the manufacturing process utilizes ceramic materials.

In some embodiments of the downhole tool, the manufacturing process utilizes phase-change materials.

In some embodiments of the downhole tool, the manufacturing process utilizes a variety of corrosion resistant, high temperature tolerant materials, on one or more shell layers, to gain a further thermal advantage.

In some embodiments of the downhole tool, conventional manufacturing processes utilize a variety of corrosion resistant, high temperature tolerant materials, on one or more shell layers to gain a further thermal advantage.

In some embodiments of the downhole tool, the passive thermal barrier further comprises an electronics carrier package housed within the hollow core; and additional heat sensitive electronics components packaged in said electronics carrier package.

In some embodiments of the downhole tool, the passive thermal barrier is manufactured in at least two pieces comprising an upper passive thermal barrier; and a lower passive thermal barrier.

In some embodiments of the downhole tool, the passive thermal barrier further comprises an intermediate passive thermal barrier between the upper passive thermal barrier and the lower passive thermal barrier.

In some embodiments of the downhole tool, the pieces of the passive thermal barrier are machined, post-manufacturing, to add assembly features comprising threads; tapers; compression fittings; screws; interlocking features; or a combination thereof.

In some embodiments of the downhole tool, the external pressure-isolating vessel components maintain seal integrity via at least metal-to-metal sealing threads.

In some embodiments of the downhole tool, the external pressure-isolating vessel components maintain seal integrity via premium downhole metal-to-metal threads further comprising sealing tapers.

In some embodiments of the downhole tool, the external pressure-isolating vessel components maintain seal integrity via O-rings, metal c-rings or comparable axial seals comprising materials adapted for anticipated temperature ranges.

In some embodiments of the downhole tool, the pressure-isolating vessel comprises a corrosion resistant alloy or steel.

In some embodiments of the downhole tool, the electronics carrier package comprises a plurality of batteries; a power processing module; a microcontroller; a microprocessor; a memory module; a data acquisition module to log data acquired from the multiple electronic components housed within the tool; or a combination thereof.

In some embodiments of the downhole tool, the plurality of batteries in the electronics carrier package are high-temperature batteries, or thermal (or Reserve) batteries.

In some embodiments of the downhole tool, the plurality of batteries in the electronics carrier package are high-temperature batteries comprising: Thionyl Chloride, Sulfuryl Chloride, Bromine Chloride, Lithium Ion, Lithium Polymer, or any combination thereof.

In some embodiments of the downhole tool, the electronics carrier package is further isolated at the approximate center of the passive thermal barrier, whereas the passive thermal barrier is non-rigidly positioned via a plurality of minimal contact points strategically positioned on an exterior layer of the passive thermal barrier to maintain the position of the passive thermal barrier approximately central to a midline axis of the external pressure-isolating vessel and further minimize radiation heat transfer, and wherein the electronics carrier package comprises a plurality of minimal contact points strategically positioned on an exterior surface to maintain the position of the electronics carrier package approximately central to the midline axis of the external pressure isolating vessel and the passive thermal barrier.

In some embodiments of the downhole tool, the manufacturing process utilizes materials specifically configured for additive manufacturing (AM).

In some embodiments of the downhole tool, the manufacturing process utilizes cast materials.

In some embodiments of the downhole tool, the manufacturing process utilizes forged materials.

In some embodiments of the downhole tool, the manufacturing process utilizes polymers.

In some embodiments of the downhole tool, the manufacturing process utilizes ceramic materials.

In some embodiments of the downhole tool, the manufacturing process utilizes a corrosion resistant alloy or corrosion resistant steel alloy.

In some embodiments of the downhole tool, the manufacturing process utilizes a variety of corrosion resistant, high temperature tolerant materials, on one or more shell layers, to gain a further thermal advantage.

In some embodiments of the downhole tool, the passive thermal barrier is configured for use within a downhole logging tool and configured to reduce heat ingress for a minimum of about 4.5 hours before exceeding a maximum of about 200° C. at the hollow core in geothermal environments comprising temperatures more than 300° C., but less than 450° C.

In some embodiments of the downhole tool, the tortuous conduction heat transfer path of the passive thermal barrier is configured to reduce heat ingress to maximize thermal performance between layers of the labyrinthine shell in order to provide at least about 10.0 hours before exceeding a maximum of about 200° C. at the hollow core, in geothermal environments operating at temperatures in excess of 300° C., but less than 400° C.

Optionally, in any embodiment, the barrier is configured for use within a downhole logging tool and configured to reduce heat ingress for a minimum of about 4.5 hours before exceeding a maximum of about 200° C. in the thermally sensitive electronics carrier package positioned within the hollow core, in geothermal environments comprising temperatures in excess of 300° C., but less than 450° C.

Optionally, in any embodiment of the passive thermal barrier, the tortuous conduction heat transfer path is configured to reduce heat ingress to maximize thermal performance between layers of the labyrinthine shell to provide at least about 10.0 hours before exceeding a maximum of about 200° C. in the thermally sensitive electronics carrier package positioned within the hollow core, in geothermal environments operating at temperatures in excess of 300° C., but less than 400° C.

Optionally, in any embodiment of the passive thermal barrier, the tortuous conduction heat transfer path is configured to reduce heat ingress to maximize thermal performance between layers of the labyrinthine shell to provide at least about 100.0 hours before exceeding a maximum of about 200° C. in the thermally sensitive electronics carrier package positioned within the hollow core, in geothermal environments operating at temperatures in excess of 300° C., but less than 400° C.

Provided herein is an apparatus for use in a borehole intersecting an earth formation, the apparatus comprising an assembly associated with a downhole tool and configured to thermally isolate a thermally sensitive component, the assembly comprising components including a pressure-tight, vacuum-sealed, external, pressure isolating vessel; an interior, passive thermal barrier; a plurality of sensing components housed within the pressure isolating vessel; a thermally sensitive electronics carrier package positioned within the passive thermal barrier, and at least one thermally sensitive electronic component positioned in the thermally sensitive electronics carrier.

In some embodiments, the apparatus is manufactured using additive manufacturing techniques.

In some embodiments, the apparatus is manufactured using conventional casting, forging, machining and/or polishing manufacturing techniques.

In some embodiments, the apparatus is manufactured using a combination of conventional casting, forging, machining, polishing and/or additive manufacturing techniques.

In some embodiments of the apparatus, the manufacturing process utilizes cast materials.

In some embodiments of the apparatus, the manufacturing process utilizes forged materials.

In some embodiments of the apparatus, the manufacturing process utilizes polymers.

In some embodiments of the apparatus, the manufacturing process utilizes ceramic materials.

In some embodiments of the apparatus, the manufacturing process utilizes a variety of corrosion resistant, high temperature tolerant materials, on one or more shell layers, to gain a further thermal advantage.

In some embodiments of the apparatus, the passive thermal barrier is manufactured from a corrosion resistant alloy or from a corrosion resistant steel.

In some embodiments of the apparatus, the passive thermal barrier is additively manufactured (AM) using powder bed metal fusion manufacturing methods comprising Direct Metal Laser Sintering (DMLS); or Electron Beam Melting (EBM).

In some embodiments of the apparatus, the passive thermal barrier is additively manufactured (AM) using Directed Energy Deposition (DED) processes which generally do not use polymeric materials but employ metal wire or powder. High energy heating sources such as a laser are directed at the material to melt it and build-up the product.

In some embodiments of the apparatus, the additive manufacturing (AM) process utilizes Lithography-based ceramic manufacturing (LCM).

In some embodiments of the apparatus, the additive manufacturing (AM) process utilizes other AM processes configured for ceramic materials.

In some embodiments of the apparatus, the passive thermal barrier comprises: a cylindrical, multi-layered labyrinthine shell structure having a plurality of at least two layers comprising an external layer and at least one internal layer with a hollow core at approximately the center; a plurality of centralizers, polarly phased and longitudinally spaced, between each layer of the multi-layered labyrinthine shell structure, radially positioned approximately radially equidistant to a central axis of the apparatus; and a plurality of point contacts polarly phased and longitudinally spaced on the external layer of the labyrinthine shell structure, radially positioned approximately radially equidistant to the central axis of the apparatus.

In some embodiments of the apparatus' passive thermal barrier, the plurality of centralizers comprises ceramic materials, glass materials, metal materials, phase-change materials or a composite thereof, to limit or reduce thermal conductivity between each layer of the labyrinthine shell structure.

In some embodiments of the apparatus, the passive thermal barrier is capsular in shape.

In some embodiments of the apparatus, the multi-layered labyrinthine shell structure of the passive thermal barrier may be rounded, columnar, tubular, conic, ovoid, annular, capsular, elliptical, ovular, cylindroid, rodlike, barrel-shaped, or any combination thereof.

In some embodiments of the apparatus, at least one internal shell layer of the multi-layered labyrinthine shell structure may be rounded, columnar, tubular, conic, ovoid, annular, elliptical, ovular, cylindroid, rodlike, barrel-shaped, or any combination thereof.

In some embodiments of the apparatus, each layer of the two or more layers of the multi-layered labyrinthine shell structure need not be the same shape as an adjacent layer.

In some embodiments of the apparatus, the passive thermal barrier comprises a first and a second end, wherein the first and second ends of the capsule may comprise hemispherical ends, flat ends, conic ends or geometrically truncated ends being partially hemispherical or conic in nature.

In some embodiments, the ends of the capsular, passive thermal barrier are the same. In some embodiments the ends of the capsular, passive thermal barrier are different shapes.

In some embodiments of the apparatus' passive thermal barrier, the plurality of centralizers are polarly phased at different radial coordinates between each layer of the labyrinthine shell structure.

In some embodiments of the apparatus' passive thermal barrier, the plurality of centralizers are further longitudinally spaced at different longitudinal locations between each layer of the labyrinthine shell structure and are further longitudinally spaced at different longitudinal locations from the layer above and or layer below when there are more than two layers.

In some embodiments of the apparatus' passive thermal barrier, the plurality of centralizers between each layer of the labyrinthine shell structure comprise: a minimum of one set of at least three centralizers between each layer, each centralizer of each set ideally spaced at 120 degrees from the nearest adjacent centralizer within the set, and wherein each centralizer within each set of at least three centralizers are longitudinally spaced apart and separated from each other centralizer in the set such that each layer of the passive thermal barrier is radially positioned approximately radially equidistant to the central axis of the assembly.

In some embodiments of the apparatus' passive thermal barrier, the plurality of centralizers comprises a minimum of one set of at least three centralizers between each layer, wherein each point contact of each set is spaced between 100 degrees and 140 degrees from the nearest adjacent point contact within the set.

In some embodiments of the apparatus' passive thermal barrier, the plurality of centralizers comprises ceramic materials.

In some embodiments of the apparatus' passive thermal barrier, the plurality of centralizers comprises two or more sets of at least three centralizers.

In some embodiments of the apparatus' passive thermal barrier, the plurality of external point contacts on the external layer of the labyrinthine shell structure comprise a minimum of one set of at least three contact points, each contact point ideally spaced at 120 degrees from the nearest adjacent contact point within the set, and wherein each contact point within each set of at least three contact points are longitudinally spaced apart and separated from each other contact point such that the passive thermal barrier would be approximately radially positioned within the pressure-tight, vacuum-sealed, external, pressure isolating vessel assembly and approximately parallel to the central axis of the assembly.

In some embodiments of the apparatus' passive thermal barrier, the plurality of external point contacts comprises a minimum of one set of at least three centralizers between each layer, wherein each point contact of each set is spaced between 100 degrees and 140 degrees from the nearest adjacent point contact within the set.

In some embodiments of the apparatus' passive thermal barrier, the plurality of external point contacts comprises ceramic materials.

In some embodiments of the apparatus' passive thermal barrier, the plurality of contact points comprises two or more sets of at least three contact points.

In some embodiments of the apparatus' passive thermal barrier, the multi-layered labyrinthine shell structure comprises at least two pieces comprising: an upper passive thermal barrier piece and a lower passive thermal barrier piece.

In some embodiments of the apparatus, the passive thermal barrier further comprises at least one intermediate passive thermal barrier piece, commonly, between the upper passive thermal barrier and the lower passive thermal barrier.

In some embodiments of the apparatus' passive thermal barrier, the pieces of the passive thermal barrier are subsequently machined, post-manufacturing, to add assembly features.

In some embodiments of the apparatus' passive thermal barrier, the assembly features comprise threads; tapers; screws; compression fittings; metal O-rings, interlocking features; or a combination thereof.

In some embodiments of the apparatus' passive thermal barrier, the passive thermal barrier's layered labyrinthine shell structure comprises at least 2 layers; at least 3 layers; at least 4 layers; at least 5 layers; or at least 6 layers.

In some embodiments of the apparatus' passive thermal barrier's layered labyrinthine shell structure, the number of layers and a mass of each layer are determined according to a calculation for a desired reduction of conductive thermal energy and radiative thermal energy transfer over a desired period.

In some embodiments of the apparatus' passive thermal barrier, said barrier is configured for use within a downhole logging tool and configured to reduce heat ingress for a minimum of about 4.5 hours before exceeding a maximum of about 200° C. at the hollow core in geothermal environments comprising temperatures more than 300° C., but less than 450° C.

In some embodiments of the apparatus' passive thermal barrier, the tortuous conduction heat transfer path is configured to reduce heat ingress to maximize thermal performance between layers of the labyrinthine shell to provide at least about 10.0 hours before exceeding a maximum of about 200° C. at the hollow core, in geothermal environments operating at temperatures more than 300° C., but less than 400° C.

Optionally, in any embodiment of the apparatus, the passive thermal barrier is configured for use within a downhole logging tool and configured to reduce heat ingress for a minimum of about 4.5 hours before exceeding a maximum of about 200° C. in the thermally sensitive electronics carrier package positioned within the hollow core, in geothermal environments comprising temperatures more than 300° C., but less than 450° C.

Optionally, in any embodiment of the apparatus, the tortuous conduction heat transfer path of the passive thermal barrier is configured to reduce heat ingress to maximize thermal performance between layers of the labyrinthine shell in order to provide at least about 10.0 hours before exceeding a maximum of about 200° C. in the thermally sensitive electronics carrier package positioned within the hollow core, in geothermal environments operating at temperatures in excess of 300° C., but less than 400° C.

Optionally, in any embodiment of the passive thermal barrier, the tortuous conduction heat transfer path is configured to reduce heat ingress to maximize thermal performance between layers of the labyrinthine shell to provide at least about 100.0 hours before exceeding a maximum of about 200° C. in the thermally sensitive electronics carrier package positioned within the hollow core, in geothermal environments operating at temperatures in excess of 300° C., but less than 400° C.

In further optional embodiments of the apparatus, the passive thermal barrier itself is configured with an additively manufactured, externally cylindrical, multi-layered labyrinthine shell structure comprising a spiral or helical internal configuration with a plurality of at least two layers, comprising an external approximately cylindrical layer and at least one internal spiraling layer when viewed in cross-section, terminating with a hollow core at or near the approximate center of the passive thermal barrier; a plurality of centralizers, polarly phased and longitudinally spaced, between each layer of the multi-layered labyrinthine shell structure, radially spaced along the helix or spiral to a central axis; and a plurality of point contacts polarly phased and longitudinally spaced on the external layer of the labyrinthine shell structure, radially equidistant to the central axis.

In some embodiments of the passive thermal barrier, the plurality of centralizers are polarly phased at different radial coordinates between each layer of the labyrinthine shell structure.

In some embodiments of the passive thermal barrier, the plurality of centralizers are further longitudinally spaced at different longitudinal locations between each layer of the labyrinthine shell structure, from the layer above and or the layer below.

In some embodiments of the passive thermal barrier, the plurality of centralizers comprise a minimum of one set of at least three centralizers between each layer, wherein each centralizer of each set is ideally spaced at 120 degrees from the nearest adjacent centralizer within the set, and wherein each centralizer within each set of at least three at least centralizers are longitudinally spaced apart and separated from each other centralizer in the set such that each layer of the passive thermal barrier would be centrally positioned and radially equidistant to the central axis of the passive thermal barrier.

In some embodiments of the passive thermal barrier, the plurality of centralizers comprises two or more sets of at least three centralizers.

In some embodiments of the passive thermal barrier, the plurality of external point contacts comprise a minimum of one set of at least three contact points between each layer, wherein each contact point is ideally spaced at 120 degrees from the nearest adjacent contact point within the set, and wherein each contact point within each set of at least three contact points are longitudinally spaced apart and separated from each other contact point such that the passive thermal barrier would be centrally positioned and radially balanced within a downhole tool, and approximately parallel to the central axis.

In some embodiments of the passive thermal barrier, the plurality of external point contacts comprises two or more sets of at least three contact points.

In some embodiments of the passive thermal barrier, the additively manufactured, multi-layered labyrinthine shell structure comprises at least two pieces comprising an upper passive thermal barrier piece and a lower passive thermal barrier piece.

In some embodiments of the passive thermal barrier, the at least two pieces of the passive thermal barrier are subsequently machined, post-additive manufacturing, to add assembly features.

In some embodiments of the passive thermal barrier, the assembly features comprise threads; tapers; screws; compression fittings; interlocking features; or a combination thereof.

In some embodiments of the passive thermal barrier, the additively manufactured, multi-layered labyrinthine shell structure of the passive thermal barrier comprises a third, fourth or more pieces, between the at least two pieces comprising the upper passive thermal barrier piece and the lower passive thermal barrier piece.

In some embodiments of the passive thermal barrier, the spiral layered labyrinthine shell structure comprises at least 2 layers; at least 3 layers; at least 4 layers; at least 5 layers; or at least 6 layers, wherein a complete spiral layer comprises 360 degrees of revolution.

In some embodiments of the passive thermal barrier, the number of layers and a mass of each layer are determined according to a calculation for a desired reduction of conductive thermal energy and radiative thermal energy transfer over a desired period.

In some embodiments, the additively manufactured, passive thermal barrier is capsular in shape.

In some embodiments of the additively manufactured, passive thermal barrier, the multi-layered labyrinthine shell structure of the passive thermal barrier may be rounded, columnar, tubular, conic, ovoid, annular, capsular, elliptical, ovular, cylindroid, rodlike, barrel-shaped, or any combination thereof.

In some embodiments of the additively manufactured, passive thermal barrier, at least one internal shell layer of the multi-layered labyrinthine shell structure may be rounded, columnar, tubular, conic, ovoid, annular, elliptical, ovular, cylindroid, rodlike, barrel-shaped, or any combination thereof.

In some embodiments of the additively manufactured, passive thermal barrier, each layer of the two or more layers of the multi-layered labyrinthine shell structure need not be the same shape as an adjacent layer.

In some embodiments, the additively manufactured, passive thermal barrier comprises a first and a second end, wherein the first and second ends of the capsule may comprise hemispherical ends, flat ends, conic ends or geometrically truncated ends being partially hemispherical or conic in nature.

In some embodiments, the ends of the capsular, additively manufactured, passive thermal barrier are the same.

In some embodiments the ends of the capsular, additively manufactured, passive thermal barrier are different shapes.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

Figure 1:
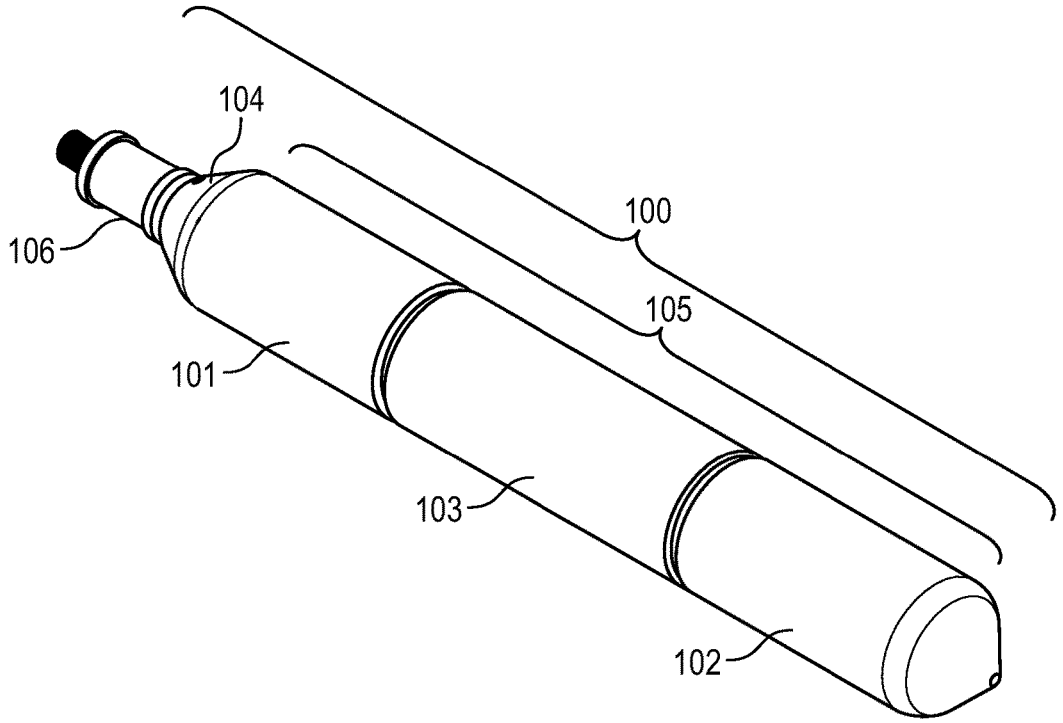
FIG. 1 is an ISO View of the entire tool.

The foregoing and other features of the present disclosure will become apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF THE INVENTION

Provided herein is a passive thermal barrier for use in a downhole tool comprising: a manufactured, generally cylindrical, multi-layered labyrinthine shell structure having a plurality of at least two layers, comprising an external shell layer and at least one internal shell layer, with a hollow core at or near the approximate center of the passive thermal barrier; a plurality of centralizers, polarly phased and longitudinally spaced, between each layer of the multi-layered labyrinthine shell structure, radially equidistant to a central axis; and a plurality of point contacts polarly phased and longitudinally spaced on the external layer of the labyrinthine shell structure, radially equidistant to the central axis.

In some embodiments, the passive thermal barrier is manufactured using additive manufacturing techniques; conventional casting techniques; conventional forging techniques; conventional machining techniques; or any combination of additive manufacturing, casting, forging and machining techniques.

In some embodiments the passive thermal barrier is further manufactured using any variety of grinding and/or polishing techniques to reduce emissivity on the internal surfaces, external surfaces or both internal and external surfaces of the at least two layers of the multi-layered labyrinthine shell structure.

Provided herein is an apparatus including an assembly associated with a downhole tool configured to thermally isolate a thermally sensitive component. Components of the assembly include a pressure-tight, vacuum-sealed, an external isolating vessel; a passive thermal barrier encased in the external isolating vessel; at least one component housed within the tool for monitoring geothermal well properties; and at least one thermally sensitive electronics carrier package positioned within the passive thermal barrier comprising thermally sensitive electronic components. The passive thermal barrier comprises a labyrinthine structure, a plurality of centralizers between each layer of the multi-layered labyrinthine shell structure and a plurality of minimal centralizing contact points between the passive thermal barrier and the external isolating vessel, in order to minimize all known heat transfer modes.

In some embodiments, the apparatus is manufactured using additive manufacturing techniques; conventional casting techniques; conventional forging techniques; conventional machining techniques; or any combination of additive manufacturing, casting, forging and machining techniques.

In some embodiments the apparatus is further manufactured using any variety of grinding and/or polishing techniques to reduce emissivity on the internal surfaces, external surfaces or both internal and external surfaces of the at least two layers of the multi-layered labyrinthine shell structure.

How the Tool Reduces the Modes of Thermal Energy Transfer

To fully appreciate the benefits of what is being disclosed, a brief summary of heat transfer is presented below.

Heat transfer is a discipline of thermal engineering that concerns the generation, use, conversion, and exchange of thermal energy (heat) between physical systems. Heat transfer is classified into various mechanisms, such as thermal conduction, thermal convection, thermal radiation, and transfer of energy by phase changes. Engineers also consider the transfer of mass of differing chemical species, either cold or hot, to achieve heat transfer. While these mechanisms have distinct characteristics, they often occur simultaneously in the same system.

For the purposes of this description, the inventors focused on the first three ways to transfer thermal energy (heat); conduction, convection and radiation.

Conduction—involves particle collision whereas collisions transfer energy from the more energetic particles to the less energetic particles. Anecdotally, this would be equivalent of touching a hot surface and you feel an instant influx of energy from the hot surface to your hand; whereas when you touch ice, you are transferring energy from your hand to the ice.

Conduction is calculated as:

$$\frac{Q}{\Delta t} = -kA\frac{\Delta T}{\Delta x} \qquad \text{Equation 1}$$

Where $Q \rightarrow$ thermal energy [Joules]

-continued $\Delta t \rightarrow$ duration of time [seconds]

$k \rightarrow$ material conductivity $\left[\frac{\text{Watts}}{\text{meter} \cdot \text{Kelvin}}\right]$ $A \rightarrow$ cross sectional area $[\text{meter}^2]$ $\Delta T \rightarrow$ temperature differential [Kelvin]

$\Delta x \rightarrow$ distance between heat source and heat measurement [meter]

Convection—involves the movement of particles from one point to another. A system gains the energy of particles that enter the system and loses the energy of particles that exit the system. Anecdotally, this would be equivalent to standing under a fan in hot weather and the movement of "fresh" air against your skin displaces the layer of air directly near your skin which has been heated via conduction from your skin replacing that air with cooler air creating a cooling effect.

$$\frac{Q}{\Delta t} = hA\Delta T \qquad \text{Equation 2}$$

Where $Q \rightarrow$ thermal energy [Joules]

$\Delta t \rightarrow$ duration of time [seconds]

$h \rightarrow$ convection heat transfer coefficient $\left[\frac{\text{Watts}}{\text{meter}^2 \cdot \text{Kelvin}}\right]$ $A \rightarrow$ exposed surface area $[\text{meter}^2]$ $\Delta T \rightarrow$ temperature differential [Kelvin]

Radiation—Due to the fact that all particles above absolute zero have thermal motion, all particles both emit energy into their environment and absorb energy from their environment. Hotter objects radiate energy more intensely due to the higher thermal motion of their particles.

Radiation Emission and Absorption is defined via the Stefan-Boltzmann Law defined as:

$$\frac{Q}{\Delta t} = \varepsilon\sigma A(T^4 - T_0^4) \qquad \text{Equation 3}$$

Where:

$Q \rightarrow$ thermal energy [Joules]

$\Delta t \rightarrow$ duration of time [seconds]

$\varepsilon \rightarrow$ emissivity [unitless–ranges from 0 to 1]

$\sigma \rightarrow$ Stefan–Boltzmann $\left[\frac{\text{Watts}}{\text{meter}^2\text{Kelvin}^4}\right]$ $A \rightarrow$ surface area of body $[\text{meter}^2]$ $T \rightarrow$ Temperature of body [Kelvin]

$T_0 \rightarrow$ Temperature of environment [Kelvin]

A Quick Overview of Specific Heat Capacity

The heat capacity of a body is defined as the amount of energy required to increase the temperature of the body. This is an important consideration of the design of the passive thermal barrier. Heat capacity is defined as: Equation 4

$$\Delta Q = mc\Delta T \qquad \text{Equation 4}$$

Where:

$\Delta Q \rightarrow$ thermal energy [Joules]

$m \rightarrow$ mass of body [kilograms]

$c \rightarrow$ specific heat capcity $\frac{\text{Joules}}{\text{kilogram} \cdot \text{Kelvin}}$ $\Delta T \rightarrow$ change in temperature [Kelvin]

How this Tool Reduces these Modes of Thermal Energy Transfer.

Conduction:

From Equation 1, to reduce conductive thermal energy transfer, the following is required:

Reduce time of exposure

Lower material conductivity

Reduce cross sectional area

Lower the temperature differential

Increase the distance between the heat source and the electronics

Since the objective of this tool is to maximize the time before the electronics reach a critical temperature at which they no longer function, the time of exposure cannot be reduced nor can the temperature of the environment and therefore the temperature differential be controlled. Therefore, the thermal conductivity of the design is minimized through design features that:

selection of a material with a low thermal conductivity increasing the path of travel reducing the cross-sectional area Material SS316 was selected as the heat sink material as one way to optimize the system for two inputs:

Thermal conductivity

Specific Heat Capacity

The tradeoff is for materials with a low thermal conductivity (k in Equation 1) the specific heat capacity (c in Equation) was also low. Therefore, from Equation 4, the heatsink (passive thermal barrier) temperature increases with less thermal energy input. SS316 offers the ideal pairing of low thermal conductivity and high specific heat capacity to provide a maximum time for heating of the heat sink. This results in a low Q in Equation 4 and a high $\Delta t$ in Equation 1.

Path of Travel

Centralizers, both equidistantly spaced longitudinally along the axis and polarly phased, serve to maintain shell separation while maximizing the conduction length between the environment and the electronics. This creates a large distance (x in Equation 1) between the environment and the electronics thereby decreasing Q in Equation 1.

Reduce Cross Sectional Area

The contact points between the passive thermal barrier and the external tool housing comprise of 3 sharp contact points spaced at 120° to reduce the total cross-sectional area. By using the minimum number of points (3) to create a plane coupled with a pointed end, the resulting cross-sectional area (A in Equation 1) is low thereby decreasing Q in Equation 1.

Convection

Given that the design described herein uses a vacuum, there are no molecules to provide heat transfer via convection, eliminating this form of heat transfer.

Radiation

The driving heat transfer mechanism of the design described herein is radiative heat transfer as conductive heat transfer is reduced through proper material selection and optimal geometry while convective heat transfer was eliminated. From Equation 3, to reduce radiative thermal energy transfer, the following is required:

Lower emissivity of the materials

Lower surface area of body

Lower the temperature differential

Since the temperature of the environment and therefore the temperature differential be controlled, the radiative thermal energy transfer of the design is minimized through design features that:

Lower emissivity of the materials

Lower surface area of body

Lower Emissivity of the Materials

Emissivity is anecdotally analog to the "brightness" or "shininess" of the surface of the material. For example, a white object in direct sunlight will absorb less energy than a black object of same size due to the lower emissivity. Similarly, a mirror will absorb even less energy than a white object of same size due to the even lower emissivity of the mirror. To lower the emissivity, a surface finish will be applied to the outer layer of the heat sink as well as the inner face of the external pressure-isolating vessel to lower the emissivity.

Figure 8:
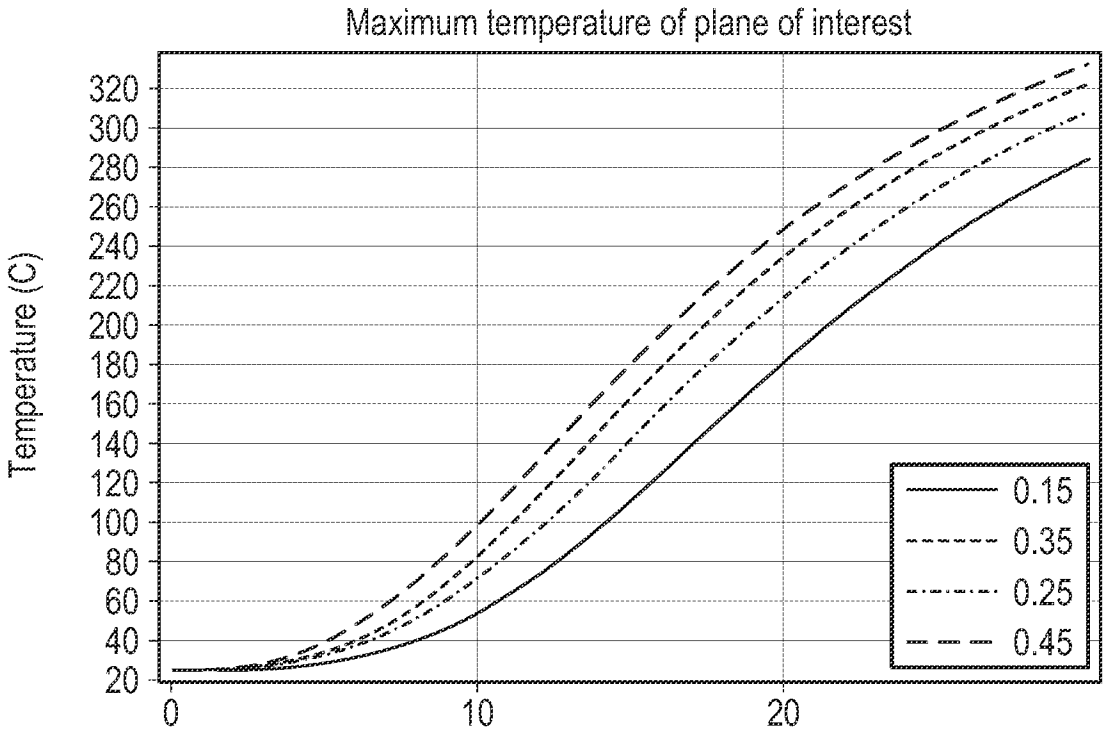
FIG. 8 is the time-temperature chart illustrating the impact of emissivity of inner surface of the sink.

As observed in the Multiphysics modelling of the geometry, illustrated in FIG. 8, for various emissivity inputs, the radiative heat transfer was reduced for lower emissivity values. The emissivity (ε in Equation 3) is low thereby decreasing Q in Equation 3.

Lower Surface Area of the Body

Through the use of a cylindrical geometry, the surface area of the heat sink is minimized per unit length resulting in low surface area (A in Equation 3) thereby decreasing Q in Equation 3.

It should be noted that a primary goal of this design is to have the lowest possible surface area for the largest possible volume. Subsequently, one additional concept implemented for this design is to incorporate hemispherical ends on the "cylinder" to make it a "capsule". By doing this, one minimizes the amount of surface area available to be radiated while maximizing the volume of material that must be heated.

Multiple Layers

Due to the dominant radiative heat transfer mechanism, layers or "shells" were designed to reduce the overall thermal heat transfer between the environment and the electronics.

Figure 7:
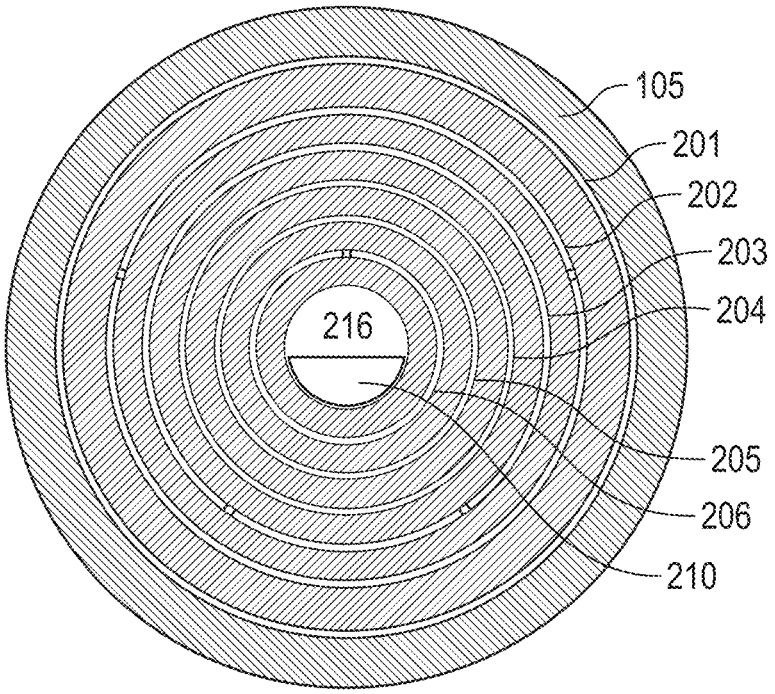
FIG. 7 is an illustrative figure showing the relative effect of multiple barrier layers versus radiative heat transfer.

The design encompasses the optimal coupling of mass of each layer (determined by the thickness) and the number of layers in the design. The radiative heat transfer is reduced through the sequence of events:

1. The external pressure vessel is heated very quickly to the environment temperature via conductive thermal energy transfer between the downhole fluid and housing according to Equation 1.
2. As the downhole housing temperature increases, some thermal energy transfer will occur via conduction (as given in Equation 1) into the outermost layer (layer 1), however most of the thermal energy transfer into layer 1 will be via radiative thermal energy transfer (as given in Equation 4).
3. As Layer 1 absorbs both conductive and radiative thermal energy transfer, the temperature of Layer 1 will increase according to Equation. If Layer 1 is thicker, the mass will be greater slowing the temperature increase of Layer 1, however for thicker layers, there are less layers available for a tool of a prescribed OD.
4. As Layer 1 temperature increases, some thermal energy transfer will occur via conduction (as given in Equation 1) into the next layer (layer 2), however most of the thermal energy transfer into layer 2 will be via radiative thermal energy transfer (as given in Equation 4) as with Layer 1.
5. As Layer 2 absorbs both conductive and radiative thermal energy transfer, the temperature of Layer 2 will increase according to Equation 4. If Layer 2 is thicker, the mass will be greater, slowing the temperature increase of Layer 2, however thicker layers, will result in less layers.
6. This process of each layer increasing in temperature and emitting energy to the adjacent layer continues until the last layer is reached. The number of layers and the thickness creating a calculated mass (m in Equation 4) was optimized to provide the lowest overall thermal energy transfer from the environment to the electronics.
7. As seen in FIG. 7, the layers provide a barrier for radiative heat transfer with decreasing temperature with increasing layer number. This design approach creates the lowest thermal energy transfer from the environment to the electronics.

As used herein, and unless otherwise specified, the term "about", "approximately" or "near" and similar terms means an acceptable error for a particular value as determined by one of ordinary skill in the art, which depends in part on how the value is measured or determined. In certain embodiments, the term "about" or "approximately" means within 1, 2, 3, or 4 standard deviations. In certain embodiments, the term "about" or "approximately" means within 30%, 25%, 20%, 15%, 10%, 9%, 8%, 7%, 6%, 5%, 4%, 3%, 2%, 1%, 0.5%, 0.1%, or 0.05% of a given value or range. In certain embodiments, the term "about" or "approximately" means within 40.0 mm, 30.0 mm, 20.0 mm, 10.0 mm 5.0 mm 1.0 mm, 0.9 mm, 0.8 mm, 0.7 mm, 0.6 mm, 0.5 mm, 0.4 mm, 0.3 mm, 0.2 mm or 0.1 mm of a given value or range. In certain embodiments, the term "about" or "approximately" means within 5.0 kg, 2.5 kg, 1.0 kg, 0.9 kg, 0.8 kg, 0.7 kg, 0.6 kg, 0.5 kg, 0.4 kg, 0.3 kg, 0.2 kg or 0.1 kg of a given value or range, including increments therein. In certain embodiments, the term "about" or "approximately" means within 1 hour, within 45 minutes, within 30 minutes, within 25 minutes, within 20 minutes, within 15 minutes, within 10 minutes, within 5 minutes, within 4 minutes, within 3 minutes within 2 minutes, or within 1 minute. In certain embodiments, the term "about" or "approximately" means within 20.0 degrees, 15.0 degrees, 10.0 degrees, 9.0 degrees, 8.0 degrees, 7.0 degrees, 6.0 degrees, 5.0 degrees, 4.0 degrees, 3.0 degrees, 2.0 degrees, 1.0 degrees, 0.9 degrees, 0.8 degrees, 0.7 degrees, 0.6 degrees, 0.5 degrees, 0.4 degrees, 0.3 degrees, 0.2 degrees, 0.1 degrees, 0.09 degrees. 0.08 degrees, 0.07 degrees, 0.06 degrees, 0.05 degrees, 0.04 degrees, 0.03 degrees, 0.02 degrees or 0.01 degrees of a given value or range, including increments therein.

As used herein, and unless otherwise specified, the term "plurality", and like terms, refers to a number (of things) comprising at least one (thing), or greater than one (thing), as in "two or more" (things), "three or more" (things), "four or more" (things), etc.

For description purposes, the term "radial" is used here to indicate a direction or position that is perpendicular relative to a longitudinal axis.

The term "axial" as used here refers to a direction or position along an axis that is parallel to a main or longitudinal axis.

The term "centralization", "central", and like terms as used herein, refers to bringing components into a concentric or concentric-like alignment about the central (longitudinal) axis or central to the midline axis of a body.

The term "longitudinal", as used herein, refers to a direction or position along a longitude or length, i.e.: running lengthwise from one end to another end along an axis.

As used herein, the terms "polar" or "radial" refer to the polar coordinate system, a two-dimensional coordinate system in which each point on a plane is determined by a distance from a reference point and an angle from a reference direction. A reference point (analogous to the origin of a Cartesian system) called the pole, and the ray from the pole in the reference direction is the polar axis. The distance from the pole is called the radial coordinate or radius, and the angle is called the angular coordinate, polar angle, or azimuth.

As used herein, the terms "comprise", "comprising", or any other variation thereof, are intended to cover a nonexclusive inclusion, such that a process, method, article, or apparatus that comprises a list of elements does not include only those elements but may include other elements not expressly listed or inherent to such process, method, article, or apparatus.

As used herein, the term "proximity" means nearness in space or relationship, but not excluding the potential to be touching. Proximity is also alternatively meant to mean that one thing may be so close to another thing as to be "in direct or nearly direct contact" (in proximity) with another thing along some point. To "place something in proximity" is also meant to mean that items are "paired" or "mated together" either in their paired function or at some point of contact.

As used herein, and unless otherwise specified, the term "cylinder", "cylindrical", "column", "columnar" and similar terms means or refers to the surface traced by a straight line moving parallel to a fixed straight line and intersecting a fixed planar closed curve; or a solid or surface bounded by a cylinder and two parallel planes cutting all its elements, or a surface or solid bounded by two parallel planes and generated by a straight line moving parallel to the given planes and tracing a curve bounded by the planes and lying in a plane perpendicular or oblique to the given planes. Alternatively, one could describe a cylinder as resembling a hollow pipe, a hollow tube, or hollow column.

As used herein, and unless otherwise specified, the term "capsule", "capsular", "spherocylindrical" and similar terms means or refers to a stadium of revolution, or a basic three-dimensional geometric shape consisting of a cylinder (see above), with hemispherical ends. Alternatively, the ends of the capsule may also be flat planar surfaces, hemi-ovular, or simply a partial hemisphere, having a volume of less than 50% of a hemisphere. Further still the ends of the capsule may also be a cone, conic or a conic section, or a cone without a vertex, having a circular end, (obtained when the cutting plane is parallel to the plane of the generating circle of the cone; for a right cone, this means the cutting plane is perpendicular to the axis), or ellipse passing through the cone before the formation of the vertex, (obtained when the cutting plane is parallel to the plane of the generating circle of the cone; for a right cone, this means the cutting plane is perpendicular to the axis).

As used herein, and unless otherwise specified, the terms "labyrinthine", "labyrinth", "tortuous", and similar terms mean or refer to a structure comprising an intricate combination of paths, layers or passages in which it is difficult to find one's way or to reach the exit, and in particular making it difficult for conduction of heat from one end to another or one layer to another. Alternatively, as used herein, "labyrinthine", "labyrinth", "tortuous", and similar terms can also refer to a maze having a series of complex, branching (multicausal) pathways including choices of path, direction and dead ends. A combined labyrinthine structure, as described herein, may have three or more dimensions.

As used herein, and unless otherwise specified, the term "helix", "helical", "spiral", and similar terms mean or refer to an object having a three-dimensional shape like that of a wire wound uniformly in a single layer around a cylinder or cone of any height, as in a corkscrew or spiral staircase. As used herein, the spiral or helix can have a singular radius from a central axis, an increasing radius, or a decreasing radius when viewed in cross-section, as if wrapped around a cone. Further still the thickness of the layers of the helix or spiral can change from the origin to the terminus of the shape. Alternative synonymous terms may comprise spiral corkscrew, curl, curlicue, twist, gyre, whorl, convolution, etc. Geometrically a helix, as used herein can also mean a curve on a conical or cylindrical surface that would become a straight line if the surface were unrolled into a plane.

As used herein, the term "additive manufacturing", "AM", "rapid prototyping" and similar terms refer to three dimensional or 3D printing processes; the construction of a three-dimensional object from a CAD model or a digital 3D model. The term "3D printing" can refer to a variety of processes in which material is deposited, joined or solidified under computer control to create a three-dimensional object, with material being added together (such as plastics, liquids or powder grains being fused together), typically layer by layer. Previously this may also have been referred to as rapid prototyping, however, in recent years, the precision, repeatability, and material range of 3D printing have increased to the point that some 3D printing processes are considered viable as an industrial-production technology, whereby the term "additive manufacturing" can be used synonymously with "3D printing", (https://en.wikipedia.org/wiki/3D_printing-cite_note-4). One of the key advantages of 3D printing is the ability to produce very complex shapes or geometries that would be otherwise impossible to construct by hand, including hollow parts or parts with internal truss structures to reduce weight.

Powder Bed Fusion techniques, or PBF, include several processes such as DMLS, SLS, SLM, MJF and EBM. Powder Bed Fusion processes can be used with an array of materials and their flexibility allows for geometrically complex structures. These techniques include selective laser sintering (SLS), with both metals and polymers, and direct metal laser sintering (DMLS). Selective laser melting does not use sintering for the fusion of powder granules but will completely melt the powder using a high-energy laser to create fully dense materials in a layer-wise method that has mechanical properties similar to those of conventional manufactured metals. Electron beam melting (EBM) is a similar type of additive manufacturing technology for metal parts (e.g.: titanium and other more exotic alloys). EBM manufactures parts by melting metal powder layer by layer with an electron beam in a high vacuum.

Powder bed fusion is one of at least seven AM techniques, in which either laser, heat or electron beam is used to melt and fuse the material together to form a three-dimensional object. Both metal and plastic parts can be made using this technique and it can be classified into the following four groups by the energy source it uses to melt the material. These are: "Laser Fused", "Electron Beam Fused"; "Fused with agent and energy"; and "Thermally Fused". Further, the Laser Fused technique can be subdivided into Selective Laser Sintering (SLS) where only plastic parts can be printed and Direct Metal Laser Sintering (DMLS) or it is sometimes called Selective Laser Melting (SLM) where, as the name suggests print metal. EBM or Electron Beam Melting comes under Electron beam fused where metal powder is fused using electron beam under high vacuum. HP's Multi Jet Fusion (MJF) comes under the third category where the powder bed is heated uniformly at the start, where a fusing agent is used to bond the powder to create 3D geometrical parts. Danish company Blueprinter's Selective Heat Sintering (SHS) technology uses a thermal print head for sintering thermoplastic powder to create 3D parts which come under the fourth category, thermal powder bed fusion.

Yet another additively manufacturing process capable of being applied herein involves using Directed Energy Deposition (DED), which generally do not use polymeric materials but employs metal wire or powder. High energy heating sources such as a laser are directed at the material to melt it and build-up the product.

How powder bed fusion works: Powder bed fusion printers have two chambers, 1) a build chamber and 2) a powder chamber, along with a coating roller to move and spread the powder material across the build chamber. In some cases, the above setup is inside a partial vacuum chamber and filled with inert gas to protect the molten material from an oxidative reaction and causing corrosion or poor metal properties. Both powder and build chambers can move up and down on a linear z-axis which is perpendicular to the top horizontal plane. Although each type of the powder bed fusion technique mentioned above varies with the different technology it uses to create the 3D parts, each broadly follows some common steps in the process to create the final part.

Still another additively manufacturing process capable of being applied herein involves using lithography-based ceramic manufacturing technology (LCM), an AM-process for high-performance and nearly dense ceramics with a high surface quality and a high resolution (635 dpi). In additive manufacturing, ceramic materials are more difficult to process than established plastic and metal-based materials. Ceramic particles can be melted and processed into solid bodies only at extremely high temperatures (>1,600° C.). As a result, pure ceramic components cannot be produced with the necessary density and hardness with standard additive processes such as SLS and SLM. To combine the advantages of 3D printing with the many positive material characteristics of ceramics, 3D objects are produced in a multi-stage process. Lithography-based ceramic manufacturing (LCM) is used to make precise high-quality components from ceramic materials, which are commonly used in microelectronics, plasma technology and high-temperature applications.

As used herein, and unless otherwise specified, the term "thermally sensitive component" (or "heat sensitive component") and similar terms shall hereinafter be used to refer to any tool, electrical component, sensor, electronic instrument, structure, or material that degrades either in performance or in integrity when exposed to temperatures above 200 degrees centigrade. For purposes of discussion, a wellbore may be considered "hot" if the ambient temperature compromises or impairs the structural integrity, operating efficient, operating life, or reliability of a given tool, device, or instrument.

As used herein, and unless otherwise specified, the term "information" and similar terms includes any form of information (Analog, digital, EM, printed, etc.).

As used herein, and unless otherwise specified, the term "processor" or "information processing device" and similar terms herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions. The processor may execute instructions stored in computer memory accessible to the processor or may employ logic implemented as field-programmable gate arrays ('FPGAs'), application-specific integrated circuits ('ASICs'), other combinatorial or sequential logic hardware, and so on. Thus, configuration of the processor may include operative connection with resident memory and peripherals for executing programmed instructions.

As used herein, the term "emissivity" refers to the effectiveness of a surface of a material in emitting energy as thermal radiation. The emissivity of the surface of a material is its effectiveness in emitting energy as thermal radiation. Thermal radiation is electromagnetic radiation that may include both visible radiation (light) and infrared radiation, which is not visible to human eyes. The thermal radiation from very hot objects is easily visible to the unaided eye. Quantitatively, emissivity is the ratio of the thermal radiation from a surface to the radiation from an ideal black surface at the same temperature as given by the Stefan-Boltzmann law. The ratio varies from 0 to 1. The surface of a perfect black body (with an emissivity of 1) emits thermal radiation at the rate of approximately 448 watts per square meter at room temperature (25° C., 298.15 K); all real objects have an emissivity less than 1.0 and emit radiation at correspondingly lower rates. For example, as it relates to thermal shielding and the protection of structures from high surface temperatures, such as reusable spacecraft or hypersonic aircraft, high emissivity coatings (HECs), with emissivity values near 0.9, are applied on the surface of insulating ceramics. This facilitates radiative cooling and protection of the underlying structure and is an alternative to ablative coatings, used in single-use reentry capsules.

Alternately, another way of looking at emissivity is to say that Emissivity is a measure of the efficiency in which a surface emits thermal energy. It is defined as the fraction of energy being emitted relative to that emitted by a thermally black surface (a black body). A black body is a material that is a perfect emitter of heat energy and has an emissivity value of 1. A material with an emissivity value of 0 would be considered a perfect thermal mirror. For example, if an object had the potential to emit 100 units of energy but only emits 90 units in the real world, then that object would have an emissivity value of 0.90. In the real world, there are no perfect "black bodies" and very few perfect infrared mirrors so most objects have an emissivity between 0 and 1. Further still, one could say that E-values (emissivity values) are usually influenced by color Black increases the e-value and white decreases its value. Surface finish also plays a major role in an object's ability to absorb or reflect radiation.

Shiny, mirror-like finishes have low e-values and reflect radiation while rough objects are more likely to absorb and emit radiation.

Surface finish, also known as surface texture or surface topography, is the nature of a surface as defined by the three characteristics of lay, surface roughness, and waviness. It comprises the small, local deviations of a surface from the perfectly flat ideal (a true plane). Each manufacturing process (such as the many kinds of machining) produces a surface texture. The process is usually optimized to ensure that the resulting texture is usable. If necessary, an additional process will be added to modify the initial texture. The latter process may be grinding (abrasive cutting), polishing, lapping, abrasive blasting, honing, electrical discharge machining (EDM), milling, lithography, industrial etching/chemical milling, laser texturing, or other processes. Surface roughness is a measure of the average texture of a part's surface, in this case, after machining. There are different parameters used to define surface roughness. One of the most ubiquitous of these is Ra (Roughness average), which is derived from the differences between heights and depths on a surface. Ra surface roughness is measured microscopically and is usually in micrometers ($\times 10^{-6}$ m). Note that surface roughness in this context is different from surface finish. The surface finish of a machined part can be improved via various finishing methods such as anodizing, bead blasting, electroplating and polishing. Surface roughness here refers to the as-machined surface texture of a part. Surface finish charts are typically measured in micrometers or microinches—the smaller the measurement, the finer the surface finish. To put a few numbers in practical terms:

- If your part has a micrometers rating of 12.5, it has a microinches rating of 500. This means that the part has a rough, low-grade surface finish most likely from coarse feeds and heavy cuts.
- If your part has a micrometers rating of 3.2, it has a microinches rating of 125. This is the roughest kind of surface recommended for parts and is often used for those that need to withstand high stress, loads, or vibration
- If your part has a micrometers rating of 0.8, it has a microinches rating of 32. This is a high-grade machining surface finish that requires closely controlled conditions but is relatively easy to achieve with cylindrical, centerless, or surface grinders. An ideal surface finish for parts that will not deal with continuous motion or heavy loads.
- If your part has a micrometers rating of 0.4, it has a microinches rating of 16. This is a high-grade, typically polished surface finish that requires closely controlled conditions but is relatively easy to achieve using a variety of polishing techniques such as wet sanding, die grinding, buffing and polishing wheels, and polishing compound to achieve an acceptable low-emissivity surface finish.
- If your part has a micrometers rating of 0.1, it has a microinches rating of 4. This is a high-grade, typically polished surface finish that requires closely controlled conditions to achieve such as electro-polishing, lapping and superfinishing.

Further still, by way of example, corresponding emissivity values for a wide variety of materials can be found in the ennoLogic® Ultimate Emissivity Table, (https://ennologic-.com/ultimate-emissivity-table/), or using commonly available infrared technology measurements to obtain values as indicated, for example, in the following FLUKE® emissivity tables: (Emissivity—Metals|Fluke Process Instruments) and (Emissivity—Non-Metals|Fluke Process Instruments), each of which is hereby incorporated by reference.

As used herein, and unless otherwise specified, the term "substantially perpendicular" and similar terms mean generally at or near 90 degrees to a given line, or surface or to the ground. In certain embodiments, the term "substantially perpendicular" means within ±20.0 degrees, ±15.0 degrees, ±10.0 degrees, ±9.0 degrees, ±8.0 degrees, ±7.0 degrees, ±6.0 degrees, ±5.0 degrees, ±4.0 degrees, ±3.0 degrees, ±2.0 degrees, ±1.0 degrees, +0.9 degrees, ±0.8 degrees, +0.7 degrees, +0.6 degrees, ±0.5 degrees, ±0.4 degrees, ±0.3 degrees, ±0.2 degrees or +0.1 degrees of a given value or range, including increments therein.

As used herein, and unless otherwise specified, the term "conveyance device" or "carrier" and similar terms means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, self-propelled tractors.

As used herein, and unless otherwise specified, the term "sub", "top sub" or "bottom sub" and similar terms refers to any structure that is configured to partially enclose, completely enclose, house, or support a device. It can also mean and refer to a short, threaded piece of pipe used to adapt parts of the drilling string that cannot otherwise be screwed together because of differences in thread size or design. A sub (i.e., "a substitute" or "sub-assembly") may also perform a special function. For example, lifting subs are used with drill collars to provide a shoulder to fit the drill pipe elevators; there are many different types of "subs" used in downhole drilling operations and virtually any type of sub can be manufactured to a customer's specification. For example; others include: a Kelly saver sub; placed between the drill pipe and the Kelly to prevent excessive thread wear of the Kelly and drill pipe threads; a bent sub is used when drilling a directional hole; Float subs are used to house the float valve within the BHA providing fluid flow control through the ID of the drill string; UBHO and Muleshoe subs are used in directional drilling BHA's and are typically run directly below a non-mag drill collar; Pup joints are key components in special drilling operations when specific spacing considerations are required; Circulating subs are made with a pin or box connection and includes a WECO figure 1502 union; All single and double side-entry subs are integral one-piece design tested to 1½ times safe working pressure. Double side-entry subs are designed with a solid ID on one end made to pump through or pressure test; Saver subs are used to extend the life of the drill stem component it is made up to by taking the wear caused by multiple connections; Crossover subs adapt to different size drill pipe connections to drill collars, or drill collars to drill collars; etc.

As used herein, the terms "heat sink", "passive thermal barrier". "passive thermal barrier housing"; "passive heat delay" or any other variation thereof, and similar terms refers to a passive heat exchanger that transfers the heat generated by or in an electronic or a mechanical device or environment to a fluid medium, often air or a liquid coolant, where it is dissipated away from the device, or at a minimum, delays the penetration or ingress of heat to another component or location of the device, thereby allowing regulation, moderation or at least, a calculable prediction of the device's temperature over time. A heat sink or passive thermal barrier is designed to maximize its surface area in contact with the cooling medium surrounding it, such as the air. Air velocity, choice of material, cooling medium, protrusion design and surface treatment are factors that affect its performance.

As used herein, the term or phrase "tortuous conduction heat transfer path" or any variation thereof, and similar terms or phrases refers to a means of construction (for the labyrinthine passive thermal barrier) or a heat exchanger, as used herein, wherein said device is formed with repeated layers having multiple layers, bends, turns, radii and minimal contact points to minimize heat ingress via conduction.

As used herein, the term or phrase "phase-change", "phase-change materials", "PCM", or any variation thereof, and similar terms or phrases refers to a substance which releases/absorbs sufficient energy at phase transition to provide useful heat or cooling. Generally, the transition will be from one of the first two fundamental states of matter—solid and liquid—to the other. The phase transition may also be between non-classical states of matter, such as the conformity of crystals, where the material goes from conforming to one crystalline structure to conforming to another, which may be a higher or lower energy state. Phase-change materials (PCMS) are combined sensible-and-latent thermal energy storage materials that can be used to store and dissipate energy in the form of heat.

Provided here is a downhole tool comprising a multi-layered passive thermal barrier with a hollow core, encased in an external pressure-isolating vessel; the external pressure-isolating vessel having at least two components comprising a top sub and a bottom sub; and a plurality of measurement and electronic components housed within the downhole tool.

In some embodiments, the downhole tool is manufactured using additive manufacturing techniques.

In some embodiments, the downhole tool is manufactured using conventional casting, forging, machining and/or polishing manufacturing techniques.

In some embodiments, the downhole tool is manufactured using a combination of conventional casting, forging, machining, polishing and/or additive manufacturing techniques.

In some embodiments of the downhole tool, the manufacturing process utilizes cast materials.

In some embodiments of the downhole tool, the manufacturing process utilizes forged materials.

In some embodiments of the downhole tool, the manufacturing process utilizes polymers.

In some embodiments of the downhole tool, the manufacturing process utilizes ceramic materials.

In some embodiments of the downhole tool, the manufacturing process utilizes a variety of corrosion resistant, high temperature tolerant materials, on one or more shell layers, to gain a further thermal advantage.

In some embodiments of the downhole tool, the passive thermal barrier is manufactured from a corrosion resistant alloy or from a corrosion resistant steel.

In some embodiments of the downhole tool, the passive thermal barrier is additively manufactured (AM) using powder bed metal fusion manufacturing methods comprising Direct Metal Laser Sintering (DMLS); or Electron Beam Melting (EBM).

In some embodiments of the downhole tool, the passive thermal barrier is additively manufactured (AM) using Directed Energy Deposition (DED) processes which generally do not use polymeric materials but employ metal wire or powder. High energy heating sources such as a laser are directed at the material to melt it and build-up the product.

In some embodiments of the downhole tool, the additive manufacturing (AM) process utilizes Lithography-based ceramic manufacturing (LCM).

In some embodiments of the downhole tool, the additive manufacturing (AM) process utilizes other AM processes configured for ceramic materials.

Figure 2A:
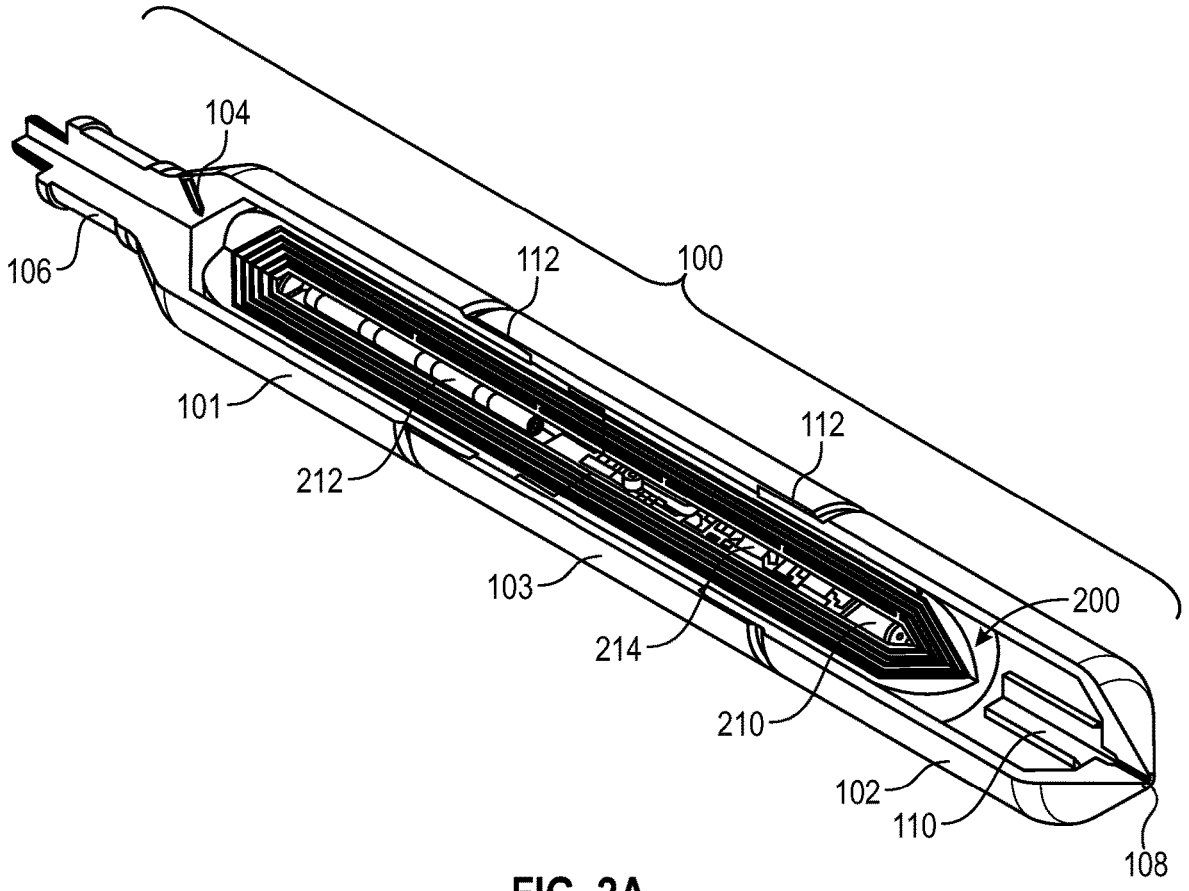
FIG. 2A is a cut-away cross-section of the ISO view of the entire tool.
Figure 2B:
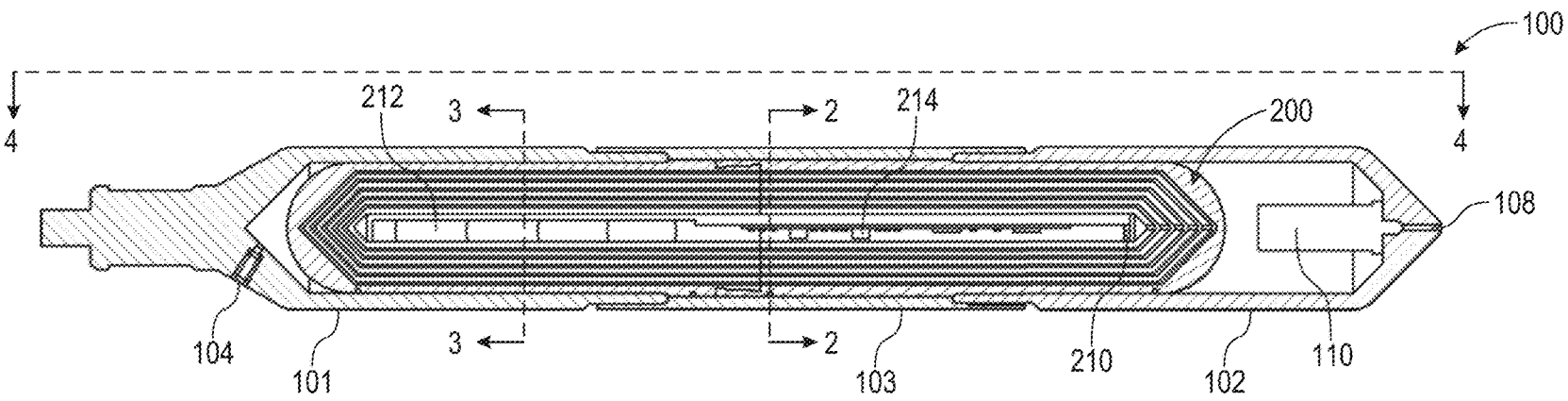
FIG. 2B is a cross-section view of entire tool.

As illustrated in FIGS. 1, 2A and 2B, a downhole tool 100 is presented comprising an external pressure-isolating vessel 105, comprising at least a top sub 101, having a fish neck 106, a bottom sub 102 and optionally, a housing 103. The optional housing is only needed in the event a longer assembly is required to accommodate a longer internal payload. The external pressure isolating vessel 105 further comprises a vacuum port 104 shown herein in the top sub, but which can be located in any of the pressure vessel components. The vacuum port is utilized to draw a vacuum on the passive thermal barrier after assembly within the tool, to remove air and essentially eliminate convection heat transfer within the tool.

Figure 2C:
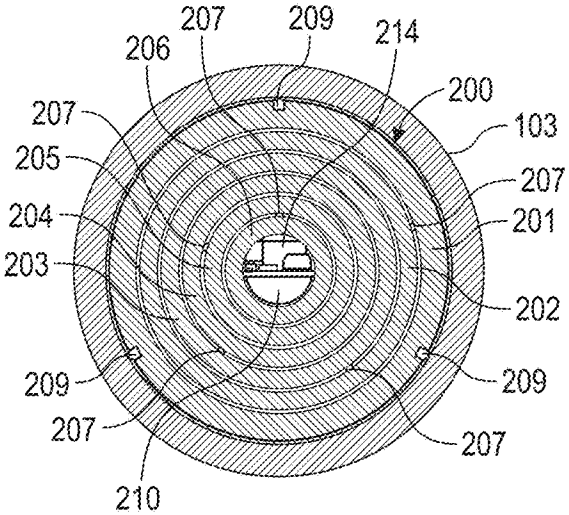
FIG. 2C is Section 2-2 of FIG. 2B.
Figure 2D:
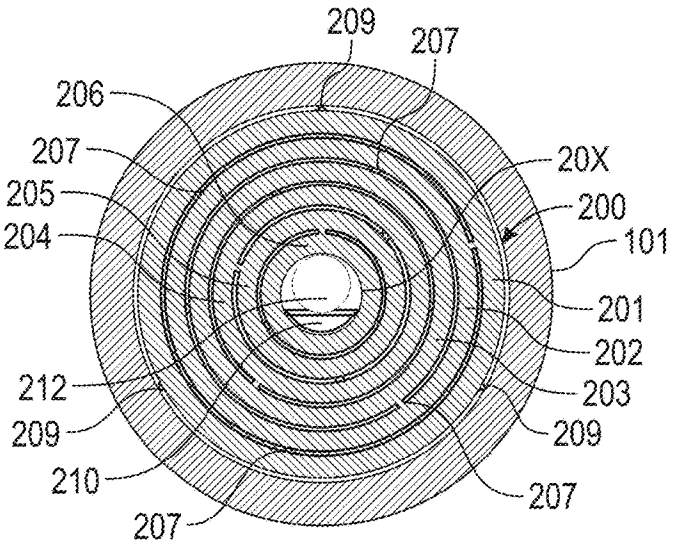
FIG. 2D is Section 3-3 of FIG. 2B.
Figure 2E:
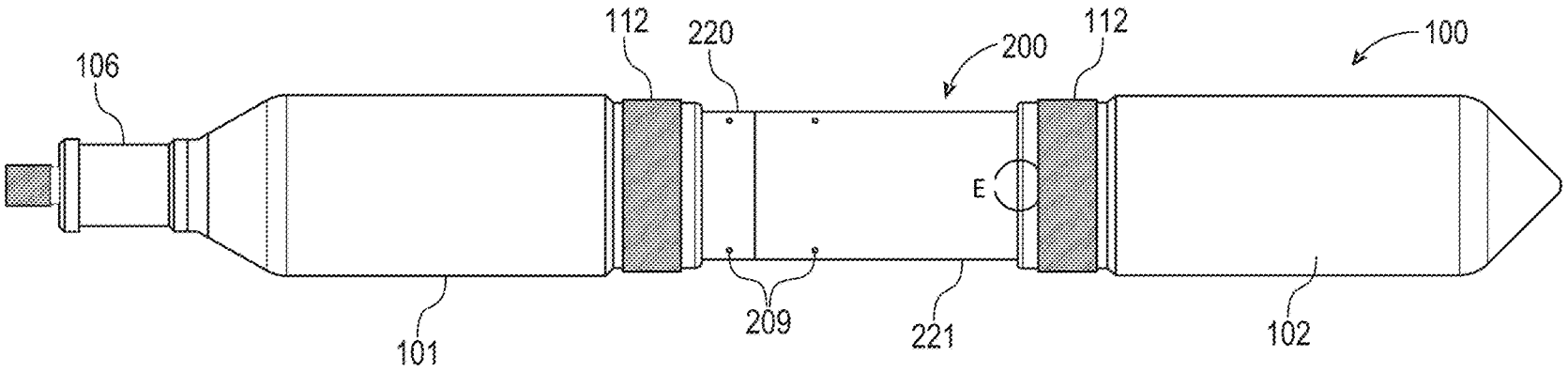
FIG. 2E is View 4-4 of FIG. 2B, showing the passive thermal barrier between the top and bottom subs (without a housing)
Figure 2F:
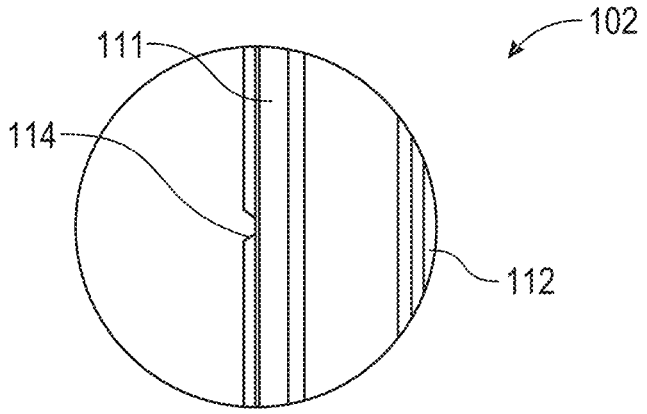
FIG. 2F is Detail E of FIG. 2E, showing an assembly end of the bottom sub with a point contact stand-off, a taper seal and premium thread.
Figure 2G:
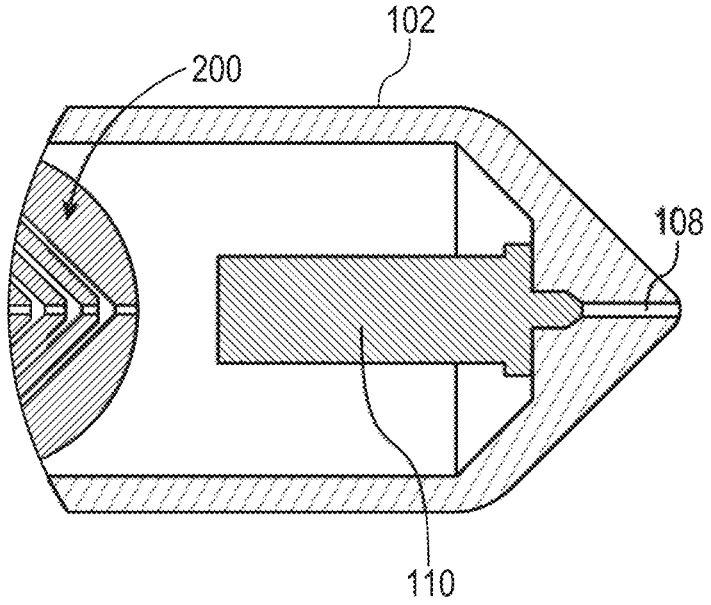
FIG. 2G is a detail view of the sensor housing in the end of the tool vessel.
Figure 3:
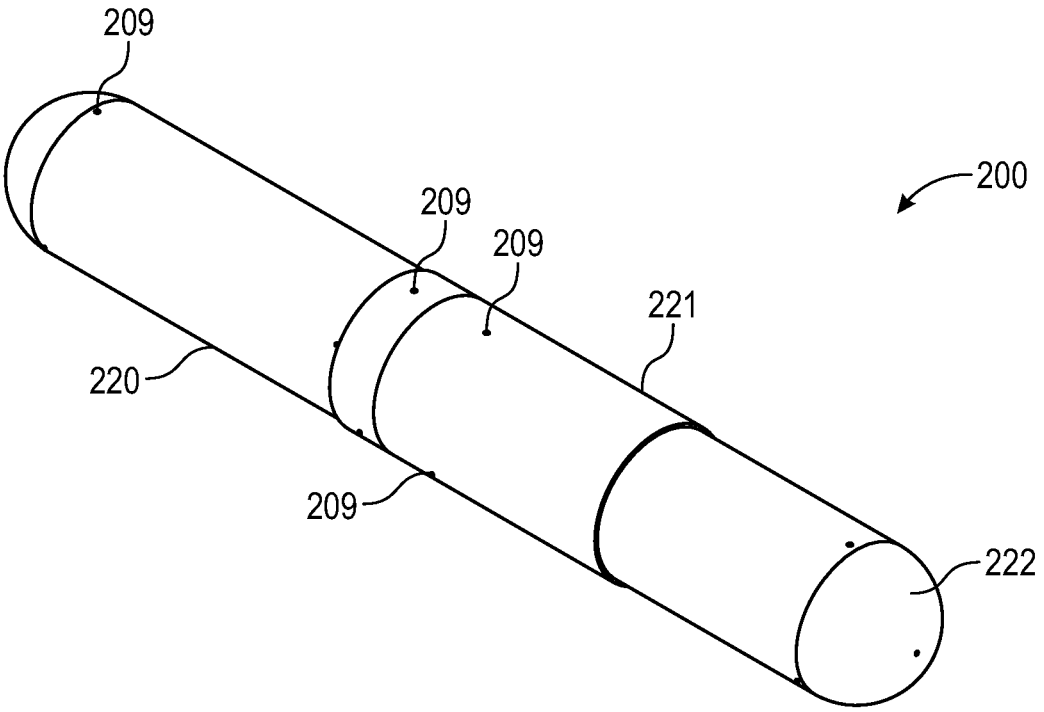
FIG. 3 is an ISO view of the passive thermal barrier.
Figure 4:
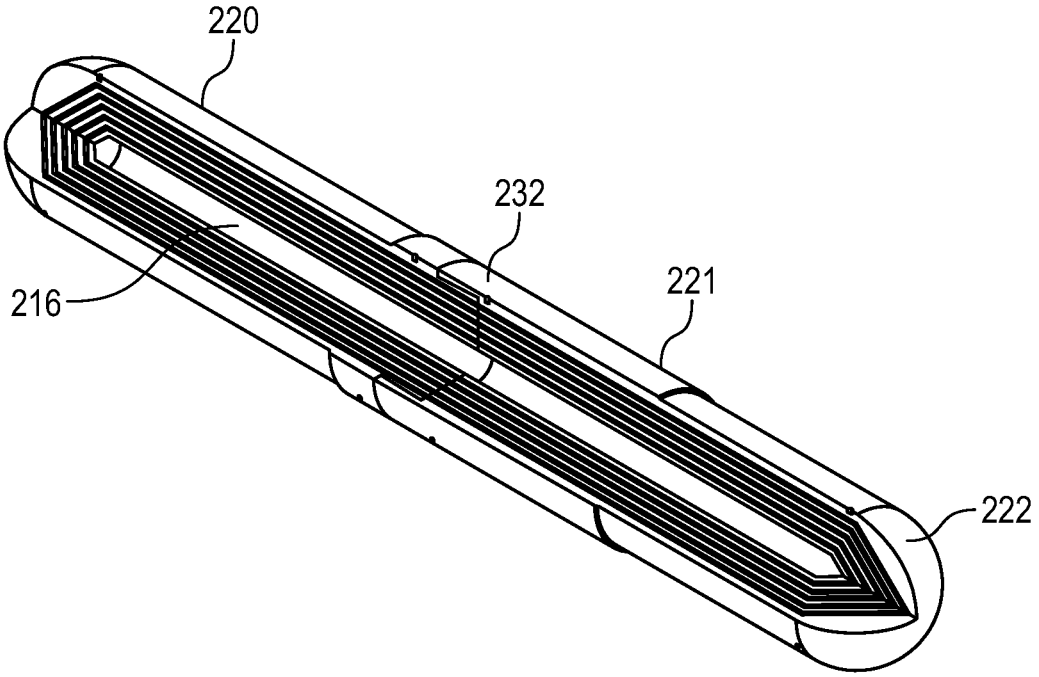
FIG. 4 is a cut-away section of the ISO view of the passive thermal barrier of FIG. 3.
Figure 5A:
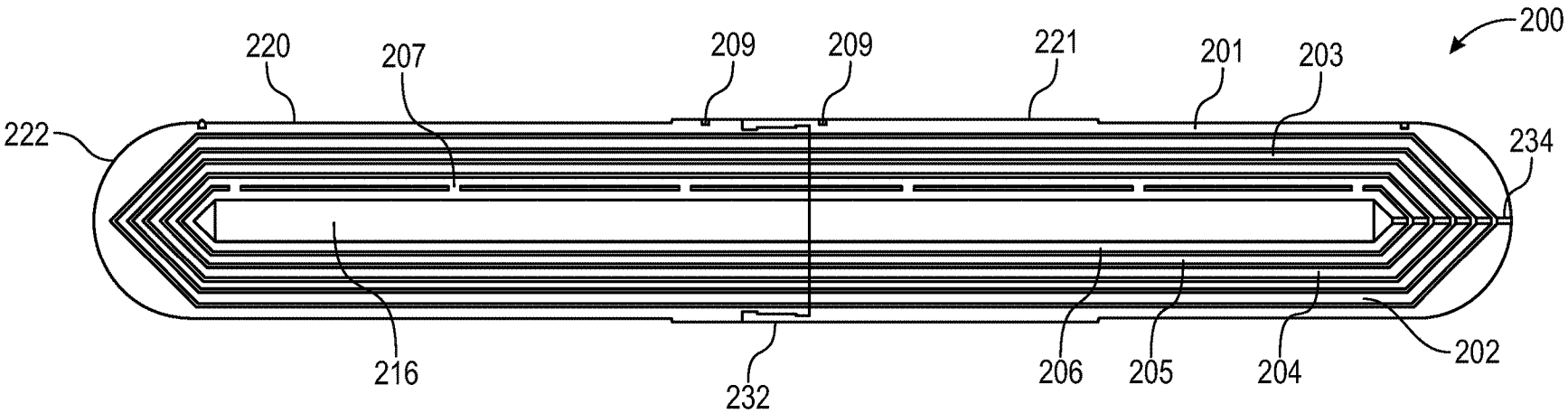
FIG. 5A is a cross-section view of the passive thermal barrier of FIG. 3.
Figure 5B:
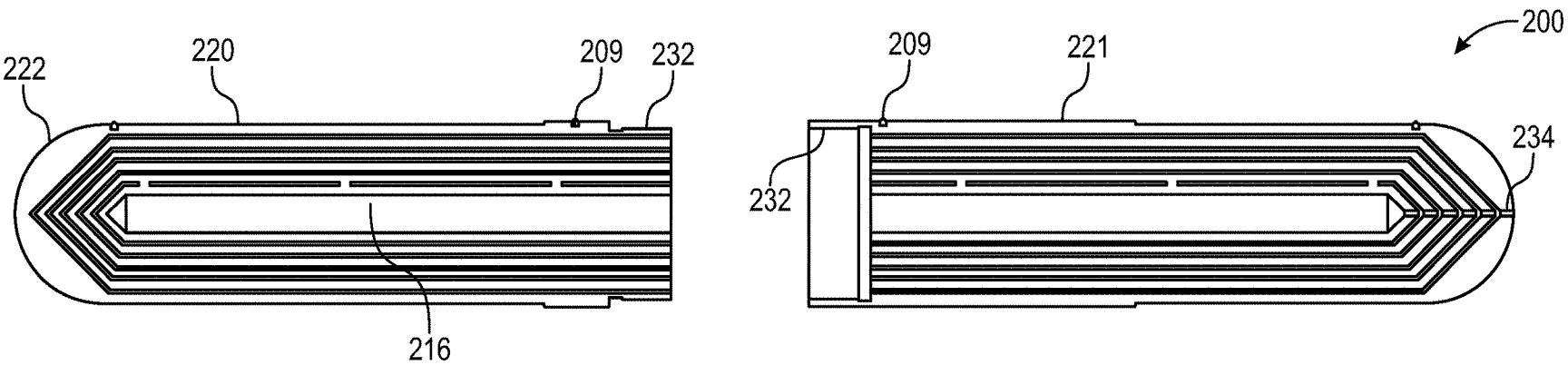
FIG. 5B is an EXPLODED View of the cross-section of the passive thermal barrier of FIG. 5A.

Further still, as shown in FIGS. 2B, 2C, and 2G the downhole tool further comprises at least a first external port 108 and optionally at least a second external port in the top sub, the bottom sub or an adjoining housing of the external pressure-isolating vessel configured for supporting measurement instruments to read geothermal data from a downhole environment. Alternately called an atmospheric sampling port 108, it is typically placed adjacent to an internal sensor chamber 110 comprising a variety of sensors and measurement equipment such as, without limitation, a thermocouple, a temperature sensor and pressure transducer. Further still, the plurality of measurement equipment contained in the sensor chamber may further comprise any one or more of a: flow meter, an accelerometer, an acoustic sensor, nuclear particle detector, a magnetometer, or any combination thereof.

In some embodiments, the downhole tool further comprises material and design properties configured to withstand a well fluid environment comprising at least about 2% H2S; the presence of HCL; a concentration of at least about 20% NaCl Brine; and a pH≥2.

In some embodiments of the passive thermal barrier, said barrier is configured for use within a geothermal energy downhole logging tool.

The components of the external pressure-isolating vessel 105 are ideally fabricated from a corrosion resistant alloy or high-quality alloy steel, such as 316L, as a non-limiting example, and are ideally assembled with premium downhole, pressure-sealing threads 112, such as Tenaris® Wedge premium 901, metal-to-metal sealing threads. However, alternative premium threads 902 and/or sealing means such as premium pressure-sealing threads 112 with sealing tapers 111, metal O-rings and premium threads are also contemplated. In some embodiments of the downhole tool, the external pressure-isolating vessel components maintain seal integrity via O-rings, metal c-rings 903 or comparable axial seals comprising materials adapted for anticipated temperature ranges.

Internal to the pressure-isolating vessel 105, a passive thermal barrier 200, sometimes referred to as a heat sink, is centrally positioned to optimize the benefits of the thermal insulating properties it provides. In one embodiment, the additively manufactured passive thermal barrier 200 is configured in a generally cylindrical layered shell configuration.

The additive manufacturing (AM) process utilized to build the passive thermal barrier can utilize a powder bed laser fusion (PBLF) manufacturing process comprising: Direct Metal Laser Sintering (DMLS); or Electron Beam Melting (EBM). Depending on the material and properties desired for the passive thermal barrier, other AM processes may also be utilized. In some embodiments of the passive thermal barrier, the additive manufacturing process utilizes a variety of corrosion resistant, high temperature tolerant materials, on alternate shell layers to gain a further thermal advantage.

In some embodiments of the downhole tool, the passive thermal barrier 200 is additively manufactured (AM) using Directed Energy Deposition (DED) processes which generally do not use polymeric materials but employ metal wire or powder. High energy heating sources such as a laser are directed at the material to melt it and build-up the product.

In some embodiments of the downhole tool, the passive thermal barrier is additively manufactured using other AM process configured for polymers.

In some embodiments of the downhole tool, the passive thermal barrier is additively manufactured with polymers utilizing AM processes comprising photopolymerization, material jetting, powder bed fusion, and material extrusion. The materials used in these processes can be in the form of liquid, powder, or solid (formed materials such as polymer film or filament).

In some embodiments of the downhole tool, the passive thermal barrier is additively manufactured with a labyrinthine design structure that provides a non-direct heat transfer path to improve conductive thermal performance and reduce heat ingress from the external housing to the hollow core 216.

In some embodiments of the downhole tool, the passive thermal barrier is additively manufactured with a Lithography-based ceramic manufacturing (LCM).

In some embodiments of the downhole tool, the passive thermal barrier is additively manufactured with a combination of AM processes and conventional casting, forging, machining grinding, polishing and/or manufacturing techniques as described previously.

As further illustrated in FIGS. 2B, 2C and 2D, the passive thermal barrier 200 is non-rigidly positioned via a plurality of minimal contact points 209 strategically positioned on an exterior barrier layer 201 of the passive thermal barrier to maintain the position of the passive thermal barrier approximately central to a midline axis of the external pressure-isolating vessel and further minimize radiation heat transfer. Ideally, the plurality of contact points comprises two or more sets of at least three contact points. Further still, the plurality of external point contacts on the external layer of the labyrinthine shell structure comprise a minimum of one set of at least three contact points between each layer, each contact point ideally spaced at 120 degrees from the nearest adjacent contact point within the set, and wherein each contact point within each set of at least three contact points are longitudinally spaced apart and separated from each other contact point such that the passive thermal barrier would be approximately radially positioned within the pressure-tight, vacuum-sealed, external, pressure isolating vessel assembly and approximately parallel to the central axis of the assembly.

The exterior barrier layer contact points 209 may further act to engage a plurality of point contact standoffs 114 found on the top and bottom sub, as illustrated in FIGS. 2E and 2F, configured to engage with the point contacts to provide a mechanism for longitudinally locating the passive thermal barrier centrally within the external pressure-isolating vessel.

In any embodiment of the passive thermal barrier, the plurality of centralizers and external contact points ideally comprise a material or materials having a low thermal conductivity.

In any embodiments of the passive thermal barrier, the plurality of centralizers and external contact points comprise ceramic materials, glass materials, metal materials, phase-change materials or a composite thereof, to limit or reduce thermal conductivity between each layer of the labyrinthine shell structure.

As further illustrated in FIGS. 2C, 2D, 5A and 5B, in some embodiments of the passive thermal barrier 200, the layered labyrinthine shell structure comprises at least 2 layers, 201, 202; at least 3 layers, 201, 202, 203; at least 4 layers, 201, 202, 203, 204; at least 5 layers, 201, 202, 203, 204, 205; or at least 6 layers, 201, 202, 203, 204, 205 and 206. In some embodiments of the passive thermal barrier, the layered labyrinthine shell structure comprises "x" layers, 201, 202, 203, 204, 205, 206 and 20X; (i.e.: more than 6 layers).

The number of layers (20X) and a mass of each layer are determined according to a calculation for a desired reduction of conductive thermal energy and radiative thermal energy transfer over a desired period, as described previously.

Additionally, a vacuum gap is positioned and maintained between each barrier layer of the passive thermal barrier by means of a plurality of centralizers 207. The plurality of centralizers between each layer of the labyrinthine shell structure comprise: a minimum of one set of at least three centralizers between each layer, each centralizer of each set ideally spaced at 120 degrees from the nearest adjacent centralizer within the set, and wherein each centralizer within each set of at least three centralizers are longitudinally spaced apart and separated from each other centralizer in the set such that each layer of the passive thermal barrier is radially positioned approximately radially equidistant to the central axis of the assembly.

In some embodiments of the apparatus' passive thermal barrier, the plurality of centralizers 207 comprise two or more sets of at least three centralizers.

In some embodiments of the passive thermal barrier, the plurality of centralizers 207 are polarly phased at different radial coordinates between each layer of the labyrinthine shell structure.

In some embodiments of the passive thermal barrier, the plurality of centralizers 207 are further longitudinally spaced at different longitudinal locations between each layer of the labyrinthine shell structure, from the layer above and or the layer below.

In some embodiments of the passive thermal barrier, the plurality of centralizers 207 comprise a minimum of one set of at least three centralizers, wherein each centralizer of each set is ideally spaced at 120 degrees from the nearest adjacent centralizer within the set, and wherein each centralizer within each set of at least three centralizers are longitudinally spaced apart and separated from each other centralizer in the set such that each layer of the passive thermal barrier would be centrally positioned and radially equidistant to the central axis of the passive thermal barrier.

In some embodiments the electronics carrier package 210 comprises a plurality of minimal centralizer contact points (not shown) strategically positioned on an exterior surface to maintain the position of the electronics carrier package approximately central to the midline axis of the passive thermal barrier and the external pressure isolating vessel.

In some embodiments of the passive thermal barrier, the structure of the labyrinthine design of each layer of the shell structure is configured to provide a tortuous conduction heat transfer path that reduces heat ingress from one layer to the next, and ultimately, to the hollow core 216.

In some embodiments the plurality of centralizers 207 comprise a shape having an end diameter of about 0.125" (⅛") or about 3.175 mm.

In some embodiments of the apparatus' passive thermal barrier, the plurality of centralizers 207 between each layer of the labyrinthine shell structure are generally less than 0.125 inches and more preferably less than approximately 0.115 inches in diameter or the equivalent thereof.

In some embodiments of the passive thermal barrier, the surface area of each of the plurality of centralizers 207 to less than about 0.0001 sq. ins to about 0.125 sq. ins. In some embodiments of the passive thermal barrier, the surface area of each of the plurality of centralizers to less than about at least about 0.0001 sq. ins. In some embodiments of the passive thermal barrier, the surface area of each of the plurality of centralizers to less than about at most about 0.125 sq. ins. In some embodiments of the passive thermal barrier, the surface area of each of the plurality of centralizers to less than about 0.0001 sq. ins to about 0.0005 sq. ins, about 0.0001 sq. ins to about 0.001 sq. ins, about 0.0001 sq. ins to about 0.00123 sq. ins, about 0.0001 sq. ins to about 0.002 sq. ins, about 0.0001 sq. ins to about 0.005 sq. ins, about 0.0001 sq. ins to about 0.01 sq. ins, about 0.0001 sq. ins to about 0.05 sq. ins, about 0.0001 sq. ins to about 0.1 sq. ins, about 0.0001 sq. ins to about 0.125 sq. ins, about 0.0005 sq. ins to about 0.001 sq. ins, about 0.0005 sq. ins to about 0.00123 sq. ins, about 0.0005 sq. ins to about 0.002 sq. ins, about 0.0005 sq. ins to about 0.005 sq. ins, about 0.0005 sq. ins to about 0.01 sq. ins, about 0.0005 sq. ins to about 0.05 sq. ins, about 0.0005 sq. ins to about 0.1 sq. ins, about 0.0005 sq. ins to about 0.125 sq. ins, about 0.001 sq. ins to about 0.00123 sq. ins, about 0.001 sq. ins to about 0.002 sq. ins, about 0.001 sq. ins to about 0.005 sq. ins, about 0.001 sq. ins to about 0.01 sq. ins, about 0.001 sq. ins to about 0.05 sq. ins, about 0.001 sq. ins to about 0.1 sq. ins, about 0.001 sq. ins to about 0.125 sq. ins, about 0.00123 sq. ins to about 0.002 sq. ins, about 0.00123 sq. ins to about 0.005 sq. ins, about 0.00123 sq. ins to about 0.01 sq. ins, about 0.00123 sq. ins to about 0.05 sq. ins, about 0.00123 sq. ins to about 0.1 sq. ins, about 0.00123 sq. ins to about 0.125 sq. ins, about 0.002 sq. ins to about 0.005 sq. ins, about 0.002 sq. ins to about 0.01 sq. ins, about 0.002 sq. ins to about 0.05 sq. ins, about 0.002 sq. ins to about 0.1 sq. ins, about 0.002 sq. ins to about 0.125 sq. ins, about 0.005 sq. ins to about 0.01 sq. ins, about 0.005 sq. ins to about 0.05 sq. ins, about 0.005 sq. ins to about 0.1 sq. ins, about 0.005 sq. ins to about 0.125 sq. ins, about 0.01 sq. ins to about 0.05 sq. ins, about 0.01 sq. ins to about 0.1 sq. ins, about 0.01 sq. ins to about 0.125 sq. ins, about 0.05 sq. ins to about 0.1 sq. ins, about 0.05 sq. ins to about 0.125 sq. ins, or about 0.1 sq. ins to about 0.125 sq. ins. In some embodiments of the passive thermal barrier, the surface area of each of the plurality of centralizers to less than about 0.0001 sq. ins, about 0.0005 sq. ins, about 0.001 sq. ins, about 0.00123 sq. ins, about 0.002 sq. ins, about 0.005 sq. ins, about 0.01 sq. ins, about 0.05 sq. ins, about 0.1 sq. ins, or about 0.125 sq. ins.

In one preferred embodiment of the passive thermal barrier 200, the tortuous conduction heat transfer path is configured to improve thermal performance between layers of the shell to reduce heat ingress by maintaining the surface area of each of the plurality of centralizers 207 to less than or equal to about 0.0123 square inches.

In some embodiments of the passive thermal barrier, the tortuous conduction heat transfer path is configured to maximize thermal performance between layers of the shell to reduce heat ingress at the hollow core 216 in geothermal environments.

As noted previously and seen in FIG. 7, the layers provide a barrier for radiative heat transfer with decreasing temperature with increasing layer number. This design approach creates the lowest thermal energy transfer from the environment to the electronics.

Further still, as illustrated in FIGS. 4, 5A, 5B and 6, at the approximate center of the cylindrical passive thermal barrier, is a hollow core 216 configured to retain and protect an electronics carrier package 210. In some embodiments, the electronics carrier package comprises a plurality of batteries 212; a power processing module 602; a microcontroller 603; a microprocessor; a memory module 604; a data acquisition module to log data acquired from the multiple electronic components housed within the tool; or a combination thereof.

Further still, the internal and/or external surfaces of the of the multi-layered labyrinthine shell structure of the passive thermal barrier 200, may be finished with a polished surface to have a surface finish to promote a thermal emissivity of about 0.05 or less. In some embodiments, the correlating surface roughness of the labyrinthine shell material is between about 8-32 μm. In some embodiments, the correlating surface roughness of the labyrinthine shell material is between about 4-16 μm.

In some embodiments, the passive thermal barrier further comprises a thermally sensitive electronics carrier package 210 positioned within the hollow core, and at least one thermally sensitive electronic component positioned within the thermally sensitive electronics carrier.

In some embodiments, the thermally sensitive electronics carrier package, the electronics carrier package, or simply the "carrier package" 210 is configured from Stainless Steel 316 but could use a different material if desired, preferably polished to reduce the emissivity as much as possible.

In some embodiments, the carrier package manufacturing process utilizes materials specifically configured for additive manufacturing (AM).

In some embodiments of the carrier package, the additive manufacturing process utilizes a variety of corrosion resistant, high temperature tolerant materials to gain a further thermal advantage.

In some embodiments of the passive thermal barrier, the at least one thermally sensitive electronic component positioned in the thermally sensitive electronics carrier package comprises: a plurality of batteries; a data acquisition module to log data acquired from measurement components; a power processing module; a microcontroller; an analog to digital converter, a microprocessor, an accelerometer, a sensor input and filtering module, an input voltage connection and protection module and at least one memory module.

Figure 6:
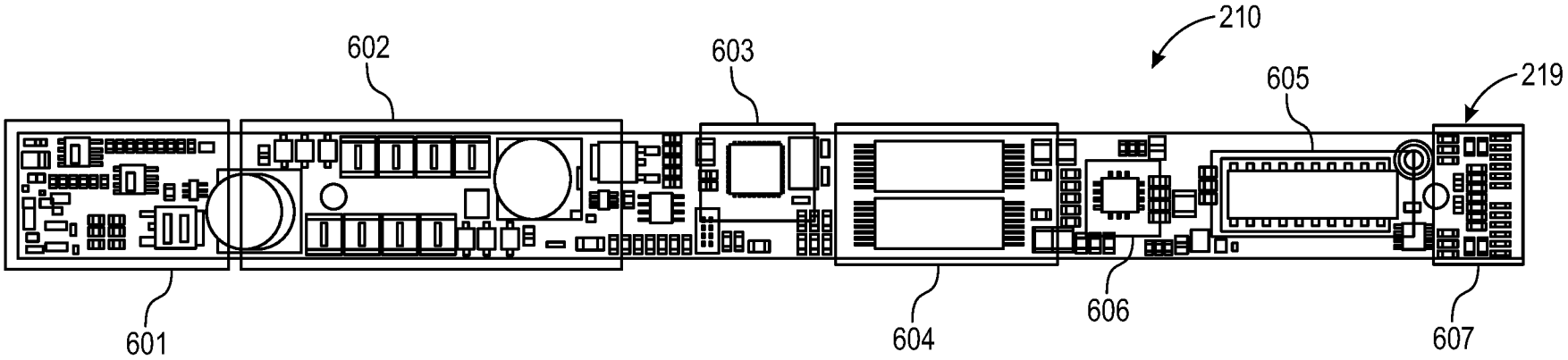
FIG. 6 is a representative detail view of thermally sensitive electronics carrier package.

As illustrated in FIG. 6, in some embodiments of the Electronics Carrier Package 210, the PCB 214 comprises a voltage input connection and protection 601, power processing circuitry 602 which may comprise Buck Converters and Low Drop Out Regulators, a microcontroller 603, at least one memory module 604, an analog-to-digital converter 605, and sensor input and filtering circuitry 607.

In some embodiments of the downhole tool, the plurality of batteries in the electronics carrier package are high-temperature batteries, or thermal (or Reserve) batteries.

In some embodiments of the downhole tool, the plurality of batteries in the electronics carrier package are high-temperature batteries comprising: Thionyl Chloride, Sulfuryl Chloride, Bromine Chloride, Lithium Ion, Lithium Polymer, or any combination thereof.

In a preferred embodiment, the Electronics Carrier Package 210, comprises a Battery Pack/Power Source 212, and a Printed Circuit Board (PCB) 214. These are the primary components that the passive thermal barrier is designed to protect for the longest possible time in a harsh geothermal environment.

As illustrated in FIG. 6, in some embodiments of the Electronics Carrier Package 210, the PCB 214 comprises a voltage input connection and protection 601, power processing circuitry 602 which may comprise Buck Converters and Low Drop Out Regulators, a microcontroller 603, at least one memory module 604, an analog-to-digital converter 605, and sensor input and filtering circuitry 607.

In some embodiments of the downhole tool, the passive thermal barrier 200 is manufactured in at least two pieces comprising an upper passive thermal barrier 220 and a lower passive thermal barrier 221.

In some embodiments of the downhole tool, the passive thermal barrier further comprises an intermediate passive thermal barrier (not shown) between the upper passive thermal barrier and the lower passive thermal barrier.

In some embodiments of the downhole tool, the pieces of the passive thermal barrier are machined, post-additive manufacturing, to add assembly features comprising threads; tapers; compression fittings; screws; interlocking features; or a combination thereof.

Figure 9A:
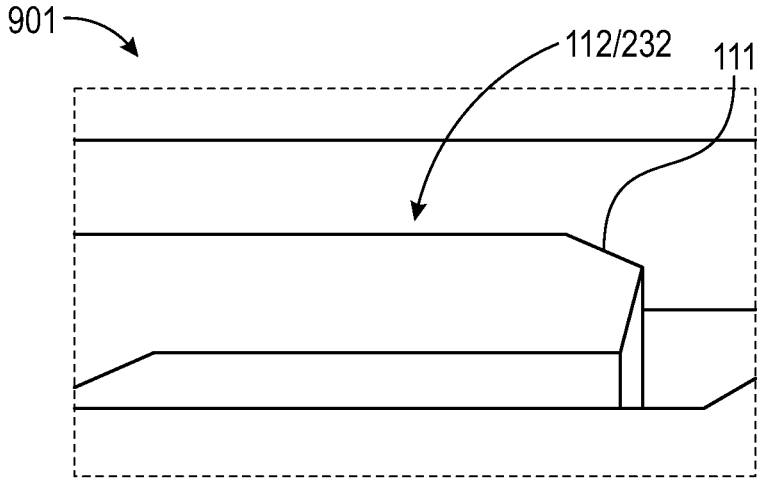
FIG. 9A is an illustrative view of a typical premium thread with a tapered seal connection employed in the vessel housing or passive thermal barrier connections.
Figure 9B:
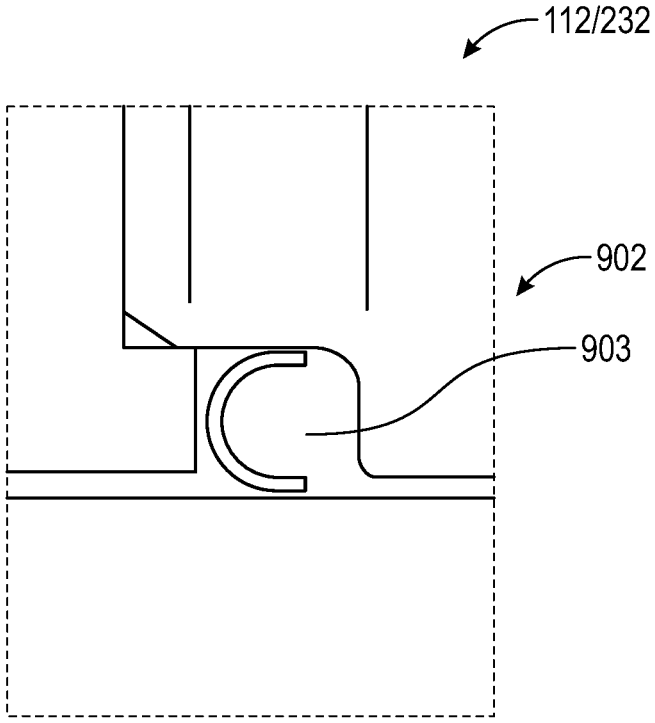
FIG. 9B is an illustrative view of an alternative typical premium thread with a ring seal connection employed in the vessel housing or passive thermal barrier connections.

As previously described and further illustrated in FIGS. 9A and 9B, an illustrative means of assembling either the exterior pressure-isolating vessel or the passive thermal barrier are with premium downhole, pressure-sealing threads 112, such as Tenaris® Wedge premium, metal-to-metal sealing threads 901. However, alternative premium threads 902 and/or sealing means such as premium pressure-sealing threads 112 with sealing tapers 111, and metal O-rings combined with premium threads are also contemplated. In some embodiments of the downhole tool, the external pressure-isolating vessel components maintain seal integrity via O-rings, metal c-rings 903 or comparable axial seals comprising materials adapted for anticipated temperature ranges.

In some embodiments of the passive thermal barrier, the outermost surface of the layered labyrinthine shell structure is configured to have a surface finish to create a thermal emissivity of about 0.05 or less. In some embodiments of the passive thermal barrier, the inner and/or outer surface layers of each layer of the layered labyrinthine shell structure is configured to have a surface finish to create a thermal emissivity of about 0.05 or less. In some embodiments, the correlating surface roughness of the labyrinthine shell material is between about 8-32 μm. In some embodiments, the correlating surface roughness of the labyrinthine shell material is between about 4-16 μm.

In some embodiments, an outermost surface of the layered labyrinthine shell structure is polished to create a low thermal emissivity of about 0.1 to about 0.5. In some embodiments, an outermost surface of the layered labyrinthine shell structure is polished to create a low thermal emissivity of at least about 0.1. In some embodiments, an outermost surface of the layered labyrinthine shell structure is polished to create a low thermal emissivity of at most about 0.5. In some embodiments, an outermost surface of the layered labyrinthine shell structure is polished to create a low thermal emissivity of about 0.5 to about 0.45, about 0.5 to about 0.4, about 0.5 to about 0.35, about 0.5 to about 0.3, about 0.5 to about 0.25, about 0.5 to about 0.2, about 0.5 to about 0.15, about 0.5 to about 0.1, about 0.45 to about 0.4, about 0.45 to about 0.35, about 0.45 to about 0.3, about 0.45 to about 0.25, about 0.45 to about 0.2, about 0.45 to about 0.15, about 0.45 to about 0.1, about 0.4 to about 0.35, about 0.4 to about 0.3, about 0.4 to about 0.25, about 0.4 to about 0.2, about 0.4 to about 0.15, about 0.4 to about 0.1, about 0.35 to about 0.3, about 0.35 to about 0.25, about 0.35 to about 0.2, about 0.35 to about 0.15, about 0.35 to about 0.1, about 0.3 to about 0.25, about 0.3 to about 0.2, about 0.3 to about 0.15, about 0.3 to about 0.1, about 0.25 to about 0.2, about 0.25 to about 0.15, about 0.25 to about 0.1, about 0.2 to about 0.15, about 0.2 to about 0.1, or about 0.15 to about 0.1. In some embodiments, an outermost surface of the layered labyrinthine shell structure is polished to create a low thermal emissivity of about 0.5, about 0.45, about 0.4, about 0.35, about 0.3, about 0.25, about 0.2, about 0.15, or about 0.1.

In some embodiments of the passive thermal barrier, the inner surfaces of the layered labyrinthine shell structure are configured to have a surface finish to create a thermal emissivity of about 0.25 or less. In some embodiments, the correlating surface roughness of the labyrinthine shell material is between about 4-16 μm.

As seen in FIG. 8, for various emissivity inputs, the radiative heat transfer was reduced for lower emissivity values. The emissivity ($\varepsilon$ in Equation 3) is low thereby decreasing Q in Equation 33.

In some embodiments of the downhole tool, the passive thermal barrier is configured for use within a downhole logging tool and configured to reduce heat ingress for a minimum of about 4.5 hours before exceeding a maximum of about 200° C. at the hollow core in geothermal environments comprising temperatures in excess of 300° C., but less than 450° C.

In some embodiments of the downhole tool, the tortuous conduction heat transfer path of the passive thermal barrier is configured to reduce heat ingress to maximize thermal performance between layers of the labyrinthine shell to provide at least about 10.0 hours before exceeding a maximum of about 200° C. at the hollow core, in geothermal environments operating at temperatures in excess of 300° C., but less than 400° C.

Optionally, in any embodiment, the barrier is configured for use within a downhole logging tool and configured to reduce heat ingress for a minimum of about 4.5 hours before exceeding a maximum of about 200° C. in the thermally sensitive electronics carrier package positioned within the hollow core, in geothermal environments comprising temperatures in excess of 300° C., but less than 450° C.

Optionally, in any embodiment of the passive thermal barrier, the tortuous conduction heat transfer path is configured to reduce heat ingress to maximize thermal performance between layers of the labyrinthine shell to provide at least about 10.0 hours before exceeding a maximum of about 200° C. in the thermally sensitive electronics carrier package positioned within the hollow core, in geothermal environments operating at temperatures in excess of 300° C., but less than 400° C.

Optionally, in any embodiment of the passive thermal barrier, the tortuous conduction heat transfer path is configured to reduce heat ingress to maximize thermal performance between layers of the labyrinthine shell to provide at least about 100.0 hours before exceeding a maximum of about 200° C. in the thermally sensitive electronics carrier package positioned within the hollow core, in geothermal environments operating at temperatures in excess of 300° C., but less than 400° C.

In some embodiments of the passive thermal barrier, the structure of the labyrinthine design of each layer of the shell structure is configured to provide a tortuous conduction heat transfer path that reduces heat ingress from one layer to the next, and ultimately, to the hollow core.

In some embodiments, the tortuous conduction heat transfer path of the layered labyrinthine shell structure is configured to maximize the thermal performance between layers of the shell in order to prevent exceeding 200 degrees C. at the hollow core in the center of the passive thermal barrier for a minimum of about 4.5 hours to about 5 hours, about 4.5 hours to about 5.5 hours, about 4.5 hours to about 6 hours, about 4.5 hours to about 6.5 hours, about 4.5 hours to about 7 hours, about 4.5 hours to about 7.5 hours, about 4.5 hours to about 8 hours, about 4.5 hours to about 8.5 hours, about 4.5 hours to about 9 hours, about 4.5 hours to about 9.5 hours, about 4.5 hours to about 10 hours, about 5 hours to about 5.5 hours, about 5 hours to about 6 hours, about 5 hours to about 6.5 hours, about 5 hours to about 7 hours, about 5 hours to about 7.5 hours, about 5 hours to about 8 hours, about 5 hours to about 8.5 hours, about 5 hours to about 9 hours, about 5 hours to about 9.5 hours, about 5 hours to about 10 hours, about 5.5 hours to about 6 hours, about 5.5 hours to about 6.5 hours, about 5.5 hours to about 7 hours, about 5.5 hours to about 7.5 hours, about 5.5 hours to about 8 hours, about 5.5 hours to about 8.5 hours, about 5.5 hours to about 9 hours, about 5.5 hours to about 9.5 hours, about 5.5 hours to about 10 hours, about 6 hours to about 6.5 hours, about 6 hours to about 7 hours, about 6 hours to about 7.5 hours, about 6 hours to about 8 hours, about 6 hours to about 8.5 hours, about 6 hours to about 9 hours, about 6 hours to about 9.5 hours, about 6 hours to about 10 hours, about 6.5 hours to about 7 hours, about 6.5 hours to about 7.5 hours, about 6.5 hours to about 8 hours, about 6.5 hours to about 8.5 hours, about 6.5 hours to about 9 hours, about 6.5 hours to about 9.5 hours, about 6.5 hours to about 10 hours, about 7 hours to about 7.5 hours, about 7 hours to about 8 hours, about 7 hours to about 8.5 hours, about 7 hours to about 9 hours, about 7 hours to about 9.5 hours, about 7 hours to about 10 hours, about 7.5 hours to about 8 hours, about 7.5 hours to about 8.5 hours, about 7.5 hours to about 9 hours, about 7.5 hours to about 9.5 hours, about 7.5 hours to about 10 hours, about 8 hours to about 8.5 hours, about 8 hours to about 9 hours, about 8 hours to about 9.5 hours, about 8 hours to about 10 hours, about 8.5 hours to about 9 hours, about 8.5 hours to about 9.5 hours, about 8.5 hours to about 10 hours, about 9 hours to about 9.5 hours, about 9 hours to about 10 hours, or about 9.5 hours to about 10 hours. In some embodiments, the tortuous conduction heat transfer path of the layered labyrinthine shell structure is configured to maximize the thermal performance between layers of the shell in order to prevent exceeding 200 degrees C. at the hollow core in the center of the passive thermal barrier for a minimum of about 4.5 hours, about 5 hours, about 5.5 hours, about 6 hours, about 6.5 hours, about 7 hours, about 7.5 hours, about 8 hours, about 8.5 hours, about 9 hours, about 9.5 hours, or about 10 hours.

Provided herein is a passive thermal barrier 200 comprising: a generally cylindrical, multi-layered labyrinthine shell structure having a plurality of at least two layers, comprising an external shell layer and at least one internal shell layer, with a hollow core at or near the approximate center of the passive thermal barrier; a plurality of centralizers, polarly phased and longitudinally spaced, between each layer of the multi-layered labyrinthine shell structure, radially equidistant to a central axis; and a plurality of point contacts polarly phased and longitudinally spaced on the external layer of the labyrinthine shell structure, radially equidistant to the central axis.

In some embodiments, the passive thermal barrier 200, is manufactured using additive manufacturing techniques.

In some embodiments, the passive thermal barrier 200, is manufactured using conventional casting, forging, machining and/or polishing manufacturing techniques.

In some embodiments, the passive thermal barrier 200, is manufactured using a combination of conventional casting, forging, machining, polishing and/or additive manufacturing techniques.

In some embodiments of the passive thermal barrier 200, the manufacturing process utilizes cast materials.

In some embodiments of the passive thermal barrier 200, the manufacturing process utilizes forged materials.

In some embodiments of the passive thermal barrier 200, the manufacturing process utilizes polymers.

In some embodiments of the passive thermal barrier 200, the manufacturing process utilizes ceramic materials.

In some embodiments of the passive thermal barrier 200, the manufacturing process utilizes a variety of corrosion resistant, high temperature tolerant materials, on one or more shell layers, to gain a further thermal advantage.

In some embodiments of the passive thermal barrier 200, the passive thermal barrier is manufactured from a corrosion resistant alloy or from a corrosion resistant steel.

In some embodiments of the passive thermal barrier 200, the passive thermal barrier is additively manufactured (AM) using powder bed metal fusion manufacturing methods comprising Direct Metal Laser Sintering (DMLS); or Electron Beam Melting (EBM).

In some embodiments of the passive thermal barrier 200, the passive thermal barrier is additively manufactured (AM) using Directed Energy Deposition (DED) processes which generally do not use polymeric materials but employ metal wire or powder. High energy heating sources such as a laser are directed at the material to melt it and build-up the product.

In some embodiments of the passive thermal barrier 200, the additive manufacturing (AM) process utilizes Lithography-based ceramic manufacturing (LCM).

In some embodiments of the passive thermal barrier 200, the additive manufacturing (AM) process utilizes other AM processes configured for ceramic materials.

As illustrated in FIGS. 2C, 2D, 3, 4, 5A and 5B, one embodiment of an additively manufactured passive thermal barrier 200, generally cylindrical in overall construction, comprising at least two components, 220, 221, each comprising a plurality of shell-like layers, 201-20X, comprising at least an external shell layer 201 and at least one internal shell layer 202 and further comprising a hollow core 216 configured to house an electronics carrier package 210.

Further, the layered structure of the additively manufactured passive thermal barrier, comprises a plurality of centralizers 207.

In some embodiments of the passive thermal barrier 200, the plurality of centralizers 207 between each layer of the labyrinthine shell structure comprise: a minimum of one set of at least three centralizers between each layer, each centralizer of each set ideally spaced at 120 degrees from the nearest adjacent centralizer within the set, and wherein each centralizer within each set of at least three centralizers are longitudinally spaced apart and separated from each other centralizer in the set such that each layer of the passive thermal barrier is radially positioned approximately radially equidistant to the central axis of the assembly. In some embodiments of the passive thermal barrier, the plurality of centralizers comprises two or more sets of at least three centralizers.

In some embodiments of the passive thermal barrier 200, the additively manufactured, multi-layered labyrinthine shell structure comprises at least two pieces comprising an upper passive thermal barrier piece 220 and a lower passive thermal barrier piece 221.

In a preferred embodiment, the additively manufactured, passive thermal barrier 200 is capsular in shape.

In some embodiments of the apparatus, the additively manufactured, passive thermal barrier 220 comprises a first end 220 and a second end 221, wherein the first and second ends 222 of the capsule may comprise hemispherical ends, flat ends, conic ends or geometrically truncated ends being partially hemispherical or conic in nature.

In some embodiments, the ends of the capsular, additively manufactured, passive thermal barrier are the same. In some embodiments the ends of the capsular, additively manufactured, passive thermal barrier are different shapes.

Further still, in at least one end 222 of the additively manufactured, passive thermal barrier, there may be a data access port 234.

In some embodiments of the passive thermal barrier, the at least two pieces of the passive thermal barrier are subsequently machined, post-additive manufacturing, to add assembly features 232.

In some embodiments of the passive thermal barrier, the assembly features comprise threads 232; tapers 211; screws; compression fittings; O-rings, c-rings 903, interlocking features or a combination thereof.

In some embodiments of the passive thermal barrier, the additively manufactured, multi-layered labyrinthine shell structure of the passive thermal barrier comprises a third, fourth or more pieces, between the at least two pieces comprising the upper passive thermal barrier piece 220 and the lower passive thermal barrier piece 221.

In some embodiments of the passive thermal barrier, the layered labyrinthine shell structure comprises at least 2 layers, 201, 202; at least 3 layers, 201, 202, 203; at least 4 layers, 201, 202, 203, 204; at least 5 layers, 201, 202, 203, 204, 205; or at least 6 layers, 201, 202, 203, 204, 205 and 206. In some embodiments of the passive thermal barrier, the layered labyrinthine shell structure comprises "x" layers, 201, 202, 203, 204, 205, 206 and 20X; (i.e.: more than 6 layers).

In some embodiments of the passive thermal barrier, the number of layers and a mass of each layer are determined according to a calculation for a desired reduction of conductive thermal energy and radiative thermal energy transfer over a desired period, as described previously.

In some embodiments of the passive thermal barrier 200, the at least two pieces of the passive thermal barrier, 220, 221 each comprise: some part of an inner layer of the multi-layered labyrinthine shell structure; some part of an outer layer of the multi-layered labyrinthine shell structure; some part of each layer of the multi-layered labyrinthine shell structure; at least 5% of each layer of the multi-layered labyrinthine shell structure; at least 15% of each layer of the multi-layered labyrinthine shell structure; at least 25% of each layer of the multi-layered labyrinthine shell structure; at least 35% of each layer of the multi-layered labyrinthine shell structure; at least 45% of each layer of the multi-layered labyrinthine shell structure; or at least one layer of the multi-layered labyrinthine shell structure.

In some embodiments of the passive thermal barrier 200, the at least two pieces of the passive thermal barrier, 220, 221 each comprise: approximately 50% of the multi-layered labyrinthine shell structure.

In some embodiments of the passive thermal barrier, the outermost surface of the layered labyrinthine shell structure is configured to have a surface finish to create a thermal emissivity of about 0.05 or less. In some embodiments, the correlating surface roughness of the labyrinthine shell material is between about 8-32 μm.

In some embodiments of the passive thermal barrier, the inner surfaces of the layered labyrinthine shell structure are configured to have a surface finish to create a thermal emissivity of about 0.25 or less. In some embodiments, the correlating surface roughness of the labyrinthine shell material is between about 8-125 μm.

Further still, as illustrated in FIGS. 4, 5A, 5B and 6, at the approximate center of the cylindrical passive thermal barrier, is a hollow core 216 configured to retain and protect an electronics carrier package 210. In some embodiments, the electronics carrier package comprises a plurality of batteries; a power processing module; a microcontroller; a microprocessor; a memory module; a data acquisition module to log data acquired from the multiple electronic components housed within the tool; or a combination thereof.

In some embodiments, the passive thermal barrier further comprises a thermally sensitive electronics carrier package 210 positioned within the hollow core, and at least one thermally sensitive electronic component positioned within the thermally sensitive electronics carrier.

In some embodiments of the passive thermal barrier, the at least one thermally sensitive electronic component positioned in the thermally sensitive electronics carrier package comprises: a plurality of batteries 212; a PCB 214, a data acquisition module to log data acquired from measurement components; a power processing module 602; a microcontroller 603; an analog to digital converter 605, a microprocessor, an accelerometer 606, a sensor input and filtering module 607, an input voltage connection and protection module 601 and at least one memory module 604.

In some embodiments of the downhole tool, the plurality of batteries in the electronics carrier package are high-temperature batteries, or thermal (or Reserve) batteries.

In some embodiments of the downhole tool, the plurality of batteries in the electronics carrier package are high-temperature batteries comprising: Thionyl Chloride, Sulfuryl Chloride, Bromine Chloride, Lithium Ion, Lithium Polymer, or any combination thereof.

In a preferred embodiment, the Electronics Carrier Package 210, comprises a Battery Pack/Power Source 212, and a Printed Circuit Board (PCB) 214. These are the primary components that the passive thermal barrier is designed to protect for the longest possible time in a harsh geothermal environment.

In some embodiments of the passive thermal barrier, said barrier is configured for use within a downhole logging tool.

In some embodiments, the downhole tool comprises: an external pressure-isolating vessel, wherein the external pressure-isolating vessel comprises at least a top sub, and a bottom sub and a plurality of measurement and electronic components housed within the tool.

In some embodiments, the external pressure-isolating vessel further comprises at least one housing between the top sub and the bottom sub.

In some embodiments, the external pressure-isolating vessel further comprises, the top sub and the bottom sub further comprise a plurality of point contact standoffs configured to engage with point contacts on the exterior surface of the on the external layer of the labyrinthine shell structure of the passive thermal barrier to provide a mechanism for longitudinally locating the passive thermal barrier centrally within the external pressure-isolating vessel.

In some embodiments, the external pressure-isolating vessel comprises a nickel-chrome based super alloy.

In some embodiments, the external pressure-isolating vessel of said downhole tool further comprises a vacuum port for drawing a vacuum on the passive thermal barrier, after assembly, to remove air to minimize convection heat transfer within the tool.

In some embodiments, the vacuum port for drawing a vacuum can be placed in the top sub; the bottom sub or the at least one housing between the top and bottom sub.

In some embodiments, the downhole tool further comprises material and design properties configured to withstand a well fluid environment comprising at least about 2% H2S; the presence of HCL; a concentration of at least about 20% NaCl Brine; and a pH≥2.

In some embodiments of the passive thermal barrier, said barrier is configured for use within a geothermal energy downhole logging tool.

In some embodiments of the passive thermal barrier, said barrier is configured for use within a downhole logging tool and configured to reduce heat ingress for a minimum of about 4.5 hours before exceeding a maximum of about 200° C. at the hollow core in geothermal environments comprising temperatures more than 300° C., but less than 450° C.

In some embodiments of the passive thermal barrier, the tortuous conduction heat transfer path is configured to reduce heat ingress to maximize thermal performance between layers of the labyrinthine shell to provide at least about 10.0 hours before exceeding a maximum of about 200° C. at the hollow core, in geothermal environments operating at temperatures in excess of 300° C., but less than 400° C.

Optionally, in any embodiment, the barrier is configured for use within a downhole logging tool and configured to reduce heat ingress for a minimum of about 4.5 hours before exceeding a maximum of about 200° C. in the thermally sensitive electronics carrier package positioned within the hollow core, in geothermal environments comprising temperatures in excess of 300° C., but less than 450° C.

Optionally, in any embodiment of the passive thermal barrier, the tortuous conduction heat transfer path is configured to reduce heat ingress to maximize thermal performance between layers of the labyrinthine shell to provide at least about 10.0 hours before exceeding a maximum of about 200° C. in the thermally sensitive electronics carrier package positioned within the hollow core, in geothermal environments operating at temperatures more than 300° C., but less than 400° C.

Optionally, in any embodiment of the passive thermal barrier, the tortuous conduction heat transfer path is configured to reduce heat ingress to maximize thermal performance between layers of the labyrinthine shell to provide at least about 100.0 hours before exceeding a maximum of about 200° C. in the thermally sensitive electronics carrier package positioned within the hollow core, in geothermal environments operating at temperatures more than 300° C., but less than 400° C.

Provided herein is an apparatus for use in a borehole intersecting an earth formation, the apparatus comprising an assembly associated with a downhole tool and configured to thermally isolate a thermally sensitive component, the assembly comprising components including a pressure-tight, vacuum-sealed, external, pressure isolating vessel; an interior, additively manufactured, passive thermal barrier; a plurality of sensing components housed within the pressure isolating vessel; a thermally sensitive electronics carrier package positioned within the passive thermal barrier, and at least one thermally sensitive electronic component positioned within the thermally sensitive electronics carrier.

In some embodiments of the apparatus, the additively manufactured, passive thermal barrier comprises: a cylindrical, multi-layered labyrinthine shell structure having a plurality of at least two layers comprising an external layer and at least one internal layer with a hollow core at approximately the center; a plurality of centralizers, polarly phased and longitudinally spaced, between each layer of the multi-layered labyrinthine shell structure, radially positioned approximately radially equidistant to a central axis of the apparatus; and a plurality of point contacts polarly phased and longitudinally spaced on the external layer of the labyrinthine shell structure, radially positioned approximately radially equidistant to the central axis of the apparatus.

In some embodiments of the apparatus, the additively manufactured, passive thermal barrier is capsular in shape.

In some embodiments of the apparatus, the additively manufactured, passive thermal barrier comprises a first and a second end, wherein the first and second ends of the capsule may comprise hemispherical ends, flat ends, conic ends or geometrically truncated ends being partially hemispherical or conic in nature.

In some embodiments, the ends of the capsular, additively manufactured, passive thermal barrier are the same. In some embodiments the ends of the capsular, additively manufactured, passive thermal barrier are different shapes.

In a preferred embodiment, the apparatus is manufactured using additive manufacturing techniques.

In some embodiments, the apparatus is manufactured using conventional casting, forging, machining and/or polishing manufacturing techniques.

In some embodiments, the apparatus is manufactured using a combination of conventional casting, forging, machining, polishing and/or additive manufacturing techniques.

In some embodiments of the apparatus, the manufacturing process utilizes cast materials.

In some embodiments of the apparatus, the manufacturing process utilizes forged materials.

In some embodiments of the apparatus, the manufacturing process utilizes polymers.

In some embodiments of the apparatus, the manufacturing process utilizes ceramic materials.

In some embodiments of the apparatus, the manufacturing process utilizes a variety of corrosion resistant, high temperature tolerant materials, on one or more shell layers, to gain a further thermal advantage.

In some embodiments of the apparatus, the passive thermal barrier is manufactured from a corrosion resistant alloy or from a corrosion resistant steel.

In some embodiments of the apparatus, the passive thermal barrier is additively manufactured (AM) using powder bed metal fusion manufacturing methods comprising Direct Metal Laser Sintering (DMLS); or Electron Beam Melting (EBM).

In some embodiments of the apparatus, the passive thermal barrier is additively manufactured (AM) using Directed Energy Deposition (DED) processes which generally do not use polymeric materials but employ metal wire or powder. High energy heating sources such as a laser are directed at the material to melt it and build-up the product.

In some embodiments of the apparatus, the additive manufacturing (AM) process utilizes Lithography-based ceramic manufacturing (LCM).

In some embodiments of the apparatus, the additive manufacturing (AM) process utilizes other AM processes configured for ceramic materials.

In some embodiments of the apparatus' passive thermal barrier, the plurality of centralizers are polarly phased at different radial coordinates between each layer of the labyrinthine shell structure.

In some embodiments of the apparatus' passive thermal barrier, the plurality of centralizers are further longitudinally spaced at different longitudinal locations between each layer of the labyrinthine shell structure and are further longitudinally spaced at different longitudinal locations from the layer above and or layer below when there are more than two layers.

In some embodiments of the apparatus' passive thermal barrier, the plurality of external point contacts on the external layer of the labyrinthine shell structure comprise a minimum of one set of at least three contact points, each contact point ideally spaced at 120 degrees from the nearest adjacent contact point within the set, and wherein each contact point within each set of at least three contact points are longitudinally spaced apart and separated from each other contact point such that the passive thermal barrier would be approximately radially positioned within the pressure-tight, vacuum-sealed, external, pressure isolating vessel assembly and approximately parallel to the central axis of the assembly.

In some embodiments of the apparatus' passive thermal barrier, the plurality of contact points comprises two or more sets of at least three contact points.

In some embodiments of the apparatus' passive thermal barrier, the additively manufactured, multi-layered labyrinthine shell structure comprises at least two pieces comprising: an upper passive thermal barrier piece and a lower passive thermal barrier piece.

In some embodiments of the apparatus, the passive thermal barrier further comprises at least one intermediate passive thermal barrier piece, commonly, between the upper passive thermal barrier and the lower passive thermal barrier.

In some embodiments of the apparatus' passive thermal barrier, the pieces of the passive thermal barrier are subsequently machined, post-additive manufacturing, to add assembly features.

In some embodiments of the apparatus' passive thermal barrier, the assembly features comprise threads; tapers; screws; compression fittings; metal O-rings, interlocking features; or a combination thereof.

In some embodiments of the apparatus' passive thermal barrier, the passive thermal barrier's layered labyrinthine shell structure comprises at least 2 layers; at least 3 layers; at least 4 layers; at least 5 layers; or at least 6 layers.

In some embodiments of the apparatus' passive thermal barrier's layered labyrinthine shell structure, the number of layers and a mass of each layer are determined according to a calculation for a desired reduction of conductive thermal energy and radiative thermal energy transfer over a desired period of time.

In some embodiments of the apparatus' passive thermal barrier, said barrier is configured for use within a downhole logging tool and configured to reduce heat ingress for a minimum of about 4.5 hours before exceeding a maximum of about 200° C. at the hollow core in geothermal environments comprising temperatures in excess of 300° C., but less than 450° C.

In some embodiments of the apparatus' passive thermal barrier, the tortuous conduction heat transfer path is configured to reduce heat ingress to maximize thermal performance between layers of the labyrinthine shell in order to provide at least about 10.0 hours before exceeding a maximum of about 200° C. at the hollow core, in geothermal environments operating at temperatures in excess of 300° C., but less than 400° C.

Optionally, in any embodiment of the apparatus, the passive thermal barrier is configured for use within a downhole logging tool and configured to reduce heat ingress for a minimum of about 4.5 hours before exceeding a maximum of about 200° C. in the thermally sensitive electronics carrier package positioned within the hollow core, in geothermal environments comprising temperatures in excess of 300° C., but less than 450° C.

Optionally, in any embodiment of the apparatus, the tortuous conduction heat transfer path of the passive thermal barrier is configured to reduce heat ingress to maximize thermal performance between layers of the labyrinthine shell in order to provide at least about 10.0 hours before exceeding a maximum of about 200° C. in the thermally sensitive electronics carrier package positioned within the hollow core, in geothermal environments operating at temperatures in excess of 300° C., but less than 400° C.

Optionally, in any embodiment of the passive thermal barrier, the tortuous conduction heat transfer path is configured to reduce heat ingress to maximize thermal performance between layers of the labyrinthine shell to provide at least about 100.0 hours before exceeding a maximum of about 200° C. in the thermally sensitive electronics carrier package positioned within the hollow core, in geothermal environments operating at temperatures in excess of 300° C., but less than 400° C.

In further optional embodiments of the apparatus, the passive thermal barrier itself is configured with an additively manufactured, externally cylindrical, multi-layered labyrinthine shell structure comprising a spiral or helical internal configuration with a plurality of at least two layers, comprising an external approximately cylindrical layer and at least one internal spiraling layer when viewed in cross-section, terminating with a hollow core at or near the approximate center of the passive thermal barrier; a plurality of centralizers, polarly phased and longitudinally spaced, between each layer of the multi-layered labyrinthine shell structure, radially spaced along the helix or spiral to a central axis; and a plurality of point contacts polarly phased and longitudinally spaced on the external layer of the labyrinthine shell structure, radially equidistant to the central axis.

In some embodiments of the passive thermal barrier, the plurality of centralizers are polarly phased at different radial coordinates between each layer of the labyrinthine shell structure.

In some embodiments of the passive thermal barrier, the plurality of centralizers are further longitudinally spaced at different longitudinal locations between each layer of the labyrinthine shell structure, from the layer above and or the layer below.

In some embodiments of the passive thermal barrier, the plurality of centralizers comprise a minimum of one set of at least three centralizers, wherein each centralizer of each set is ideally spaced at 120 degrees from the nearest adjacent centralizer within the set, and wherein each centralizer within each set of at least three at least centralizers are longitudinally spaced apart and separated from each other centralizer in the set such that each layer of the passive thermal barrier would be centrally positioned and radially equidistant to the central axis of the passive thermal barrier.

In some embodiments of the passive thermal barrier, the plurality of centralizers comprises two or more sets of at least three centralizers.

In some embodiments of the passive thermal barrier, the plurality of external point contacts comprise a minimum of one set of at least three contact points, wherein each contact point is ideally spaced at 120 degrees from the nearest adjacent contact point within the set, and wherein each contact point within each set of at least three contact points are longitudinally spaced apart and separated from each other contact point such that the passive thermal barrier would be centrally positioned and radially balanced within a downhole tool, and approximately parallel to the central axis.

In some embodiments of the passive thermal barrier, the plurality of external point contacts comprises two or more sets of at least three contact points.

In some embodiments of the passive thermal barrier, the additively manufactured, multi-layered labyrinthine shell structure comprises at least two pieces comprising an upper passive thermal barrier piece and a lower passive thermal barrier piece.

In some embodiments of the passive thermal barrier, the at least two pieces of the passive thermal barrier are subsequently machined, post-additive manufacturing, to add assembly features.

In some embodiments of the passive thermal barrier, the assembly features comprise threads; tapers; screws; compression fittings; interlocking features; or a combination thereof.

In some embodiments of the passive thermal barrier, the additively manufactured, multi-layered labyrinthine shell structure of the passive thermal barrier comprises a third, fourth or more pieces, between the at least two pieces comprising the upper passive thermal barrier piece and the lower passive thermal barrier piece.

In some embodiments of the passive thermal barrier, the spiral layered labyrinthine shell structure comprises at least 2 layers; at least 3 layers; at least 4 layers; at least 5 layers; or at least 6 layers, wherein a complete spiral layer comprises 360 degrees of revolution.

In some embodiments of the passive thermal barrier, the number of layers and a mass of each layer are determined according to a calculation for a desired reduction of conductive thermal energy and radiative thermal energy transfer over a desired period.

In some embodiments, the additively manufactured, passive thermal barrier is capsular in shape.

In some embodiments, the additively manufactured, passive thermal barrier comprises a first and a second end, wherein the first and second ends of the capsule may comprise hemispherical ends, flat ends, conic ends or geometrically truncated ends being partially hemispherical or conic in nature.

In some embodiments, the ends of the capsular, additively manufactured, passive thermal barrier are the same.

In some embodiments the ends of the capsular, additively manufactured, passive thermal barrier are different shapes.

While certain embodiments of the present invention have been shown and described herein, it will be obvious to those skilled in the art that such embodiments are provided by way of example only. Numerous variations, changes, and substitutions will now occur to those skilled in the art without departing from the invention. It should be understood by a person of skill in the art that various alternatives to the embodiments of the invention described herein may be employed in practicing the invention. It is intended that the following claims define the scope of the invention and that methods and structures within the scope of these claims and their equivalents be covered thereby.

What is claimed is:

1. A passive thermal barrier for use in a downhole tool comprising:

a multi-layered labyrinthine shell structure having a plurality of layers comprising an external layer and at least one internal layer;

a plurality of centralizers, polarly phased and longitudinally spaced, between each layer of the multi-layered labyrinthine shell structure; and a plurality of point contacts polarly phased and longitudinally spaced on the external layer of the labyrinthine shell structure, radially equidistant to the central axis and comprising a material or materials having a low thermal conductivity;

wherein the plurality of centralizers between each layer of the multi-layered labyrinthine shell structure are radially equidistant to a central axis and comprise a material or materials having a low thermal conductivity, and wherein said multi-layered labyrinthine shell structure is configured to reduce heat ingress from the external layer to the hollow core.

2. The passive thermal barrier of claim 1, wherein the passive thermal barrier is manufactured using:

additive manufacturing techniques;

conventional casting techniques;

conventional forging techniques;

conventional machining techniques; or any combination of additive manufacturing, casting, forging and machining techniques;

wherein utilizing said processes with a variety of corrosion resistant, high temperature tolerant materials provides a thermal advantage to further reduce heat ingress from the external layer to the hollow core.

3. The passive thermal barrier of claim 2, wherein the passive thermal barrier is further manufactured using any variety of polishing techniques to reduce emissivity on the internal surfaces, external surfaces or both internal and external surfaces of the plurality of layers of the multi-layered labyrinthine shell structure, wherein the outermost surface of the layered labyrinthine shell structure is configured to have a surface finish with a thermal emissivity of about 0.05 or less and correlating surface roughness of the outermost labyrinthine shell material is between about 8-32 μm, and wherein the inner surfaces of the layered labyrinthine shell structure are configured to have a surface finish with a thermal emissivity of about 0.25 or less and correlating surface roughness is between about 8-125 μm.

4. The passive thermal barrier of claim 2, wherein said multi-layered labyrinthine shell structure comprises at least two pieces comprising:

an upper cylindrical passive thermal barrier piece; and a lower cylindrical passive thermal barrier piece; and wherein other internal layers of the plurality of layers may comprise at least two tubular, conic, ovoid, annular, capsular, elliptical, ovular, cylindroid, rodlike, or barrel-shaped pieces, or any combination thereof.

5. The passive thermal barrier of claim 4, wherein the at least two pieces of the passive thermal barrier are subsequently machined, post-manufacturing, using any variety of grinding and polishing techniques to reduce emissivity.

6. The passive thermal barrier of claim 5, wherein the at least two pieces of the passive thermal barrier are subsequently machined, to add assembly features, wherein said assembly features comprise:

threads;
tapers;
screws;
compression fittings;
interlocking features;
metal O-rings; or
a combination thereof.

7. The passive thermal barrier of claim 4, wherein the at least two pieces of the passive thermal barrier each comprise:

some part of an inner layer of the multi-layered labyrinthine shell structure;
some part of an outer layer of the multi-layered labyrinthine shell structure;
some part of each layer of the multi-layered labyrinthine shell structure;
at least 5% of each layer of the multi-layered labyrinthine shell structure;
at least 15% of each layer of the multi-layered labyrinthine shell structure;
at least 25% of each layer of the multi-layered labyrinthine shell structure;
at least 35% of each layer of the multi-layered labyrinthine shell structure;
at least 45% of each layer of the multi-layered labyrinthine shell structure; or
at least one layer of the multi-layered labyrinthine shell structure.

8. The passive thermal barrier of claim 4, wherein each layer of the multi-layered labyrinthine shell structure is a different shape or the same shape as an adjacent layer.

9. The passive thermal barrier of claim 2, wherein the additive manufacturing process utilizes powder bed laser fusion (PBLF) manufacturing comprising:

Direct Metal Laser Sintering (DMLS);
Electron Beam Melting (EBM); or
Directed Energy Deposition (DED);
wherein said powder bed laser fusion utilizes a variety of corrosion resistant and/or high temperature tolerant materials to gain a thermal advantage to further reduce heat ingress from the external layer to the hollow core.

10. The passive thermal barrier of claim 2, wherein the manufacturing process utilizes a corrosion resistant alloy or steel.

11. The passive thermal barrier of claim 1, wherein the plurality of centralizers are at different radial coordinates between each layer of the labyrinthine shell structure.

12. The passive thermal barrier of claim 11, wherein the plurality of centralizers are further longitudinally spaced at different longitudinal locations between each layer of the labyrinthine shell structure.

13. The passive thermal barrier of claim 11, wherein the plurality of centralizers comprises:

minimum of one set of three centralizers, each centralizer of each set spaced between 100 degrees and 140 degrees from the nearest adjacent centralizer within the set, and
wherein each centralizer within each set of at least two three centralizers are longitudinally spaced apart and separated from each other centralizer in the set such that each layer of the passive thermal barrier would be centrally positioned and radially equidistant to the central axis of the passive thermal barrier.

14. The passive thermal barrier of claim 1, wherein the plurality of external point contacts on the external layer of the labyrinthine shell structure comprise:

a minimum of two sets of three point contacts, each point contact spaced at about 120 degrees from the nearest adjacent point contact within the set, and
wherein each point contact within each set of three external point contacts are longitudinally spaced apart and separated from each other point contact such that the passive thermal barrier would be centrally positioned and radially balanced within a downhole tool conveyance device.

15. The passive thermal barrier of claim 1, wherein the multi-layered labyrinthine shell structure comprises:

at least 2 internal layers;
at least 3 internal layers;
at least 4 internal layers;
at least 5 internal layers; or
at least 6 internal layers.

16. The passive thermal barrier of claim 15, wherein the number of layers and a mass of each layer are determined according to a calculation for a desired reduction of conductive thermal energy and radiative thermal energy transfer over a desired period, based in part on a selection of corrosion resistant and/or high temperature tolerant materials.

17. The passive thermal barrier of claim 1, wherein the structure of the labyrinthine design of each layer of the shell structure is configured to provide a tortuous conduction heat transfer path that reduces heat ingress to the hollow core.

18. The passive thermal barrier of claim 1, further comprising a thermally sensitive electronics carrier package configurable for positioning within the hollow core, and at least one thermally sensitive electronic component positioned in the thermally sensitive electronics carrier.

19. The thermally sensitive electronics carrier package of claim 18, wherein the at least one thermally sensitive electronic component comprises:

a plurality of batteries;
a data acquisition module to log data acquired from measurement components;
a power processing module;
a microcontroller;
a microprocessor; and
a memory module.

20. The passive thermal barrier of claim 18, wherein said barrier is configured for use within a downhole tool.

21. The downhole tool of claim 20, wherein said downhole tool comprises:

an external pressure-isolating vessel, and
wherein the external pressure-isolating vessel comprises at least a top sub, and a bottom sub.

22. The downhole tool of claim 20, wherein the external pressure-isolating vessel comprises a vacuum port for drawing a vacuum on the passive thermal barrier, after assembly, to remove air and to form a vacuum gap between each layer.

23. The downhole tool of claim 22, wherein the external pressure-isolating vessel is pressure-tight and vacuum-sealed, and the vacuum gap between each layer minimizes convection heat transfer within the tool.

24. The downhole tool of claim 20, wherein the external pressure-isolating vessel comprises a nickel-chrome based super alloy.

* * * * *